US011598282B1

(12) United States Patent
Josselyn

(10) Patent No.: US 11,598,282 B1
(45) Date of Patent: Mar. 7, 2023

(54) SYSTEMS AND METHODS FOR OPTIMIZING VESSEL FUEL CONSUMPTION

(71) Applicant: Atlantic Towing Limited, Saint John (CA)

(72) Inventor: Andrew William Josselyn, Rothesay (CA)

(73) Assignee: Atlantic Towing Limited, Saint John (CA)

( * ) Notice: Subject to any disclaimer, the term of this patent is extended or adjusted under 35 U.S.C. 154(b) by 0 days.

(21) Appl. No.: 17/678,420

(22) Filed: Feb. 23, 2022

(51) Int. Cl.

| | |
|---|---|
| ***F02D 41/24*** | (2006.01) |
| ***F02D 41/14*** | (2006.01) |
| ***F02D 29/02*** | (2006.01) |
| ***B63B 79/20*** | (2020.01) |

(Continued)

(52) U.S. Cl.
CPC ..... *F02D 41/2451* (2013.01); *B63B 71/00* (2020.01); *B63B 79/20* (2020.01); *B63B 79/40* (2020.01); *F02D 29/02* (2013.01); *F02D 41/1401* (2013.01); *F02D 41/2432* (2013.01); *F02D 2041/1412* (2013.01);
(Continued)

(58) Field of Classification Search
CPC ..... F02D 29/02; F02D 41/14; F02D 41/1401; F02D 41/24; F02D 41/2432; F02D 41/2451; F02D 2041/1412; F02D 2041/1433; F02D 2200/0625; F02D 2200/501; B63B 71/00; B63B 79/20; B63B 79/40; B63J 99/00; G01C 21/203; G05D 1/00; G05D 1/0005; G06Q 50/10
See application file for complete search history.

(56) References Cited

U.S. PATENT DOCUMENTS

| | | | |
|---|---|---|---|
| 10,000,262 | B2 | 6/2018 | Ando et al. |
| 10,370,063 | B2 | 8/2019 | Skidmore |

(Continued)

FOREIGN PATENT DOCUMENTS

| | | | |
|---|---|---|---|
| CN | 204479118 | U | 7/2015 |
| CN | 106184649 | A | 12/2016 |

(Continued)

*Primary Examiner* — John Kwon
*Assistant Examiner* — Johnny H Hoang
(74) *Attorney, Agent, or Firm* — Bereskin & Parr LLP/S.E.N.C.R.L., s.r.l.

(57) ABSTRACT

An optimum engine configuration is determined, based on a predicted required power, for a seafaring vessel having a plurality of thrust engines. The predicted required power is determined by inputting vessel operational data, environmental data, and voyage data to a required power model. At least some of the vessel operational data and environmental data is received from a plurality of sensors positioned onboard the vessel. The optimum engine configuration is selected from a plurality of candidate engine configurations. Each candidate engine configuration includes a specified number of thrust engines running and a specified power output level of each thrust engine. The optimum engine configuration is selected based on a candidate total predicted fuel consumption of each candidate engine configuration. The candidate total predicted fuel consumption amount is determined as a sum of the engine-specific predicted fuel consumptions determined for each running thrust engine of that candidate engine configuration.

27 Claims, 13 Drawing Sheets

(51) Int. Cl.
*B63B 79/40* (2020.01)
*B63B 71/00* (2020.01)

(52) U.S. Cl.
CPC ..... *F02D 2041/1433* (2013.01); *F02D 2200/0625* (2013.01); *F02D 2200/501* (2013.01)

(56) References Cited

U.S. PATENT DOCUMENTS

| | | | | |
|---|---|---|---|---|
| 2015/0149135 | A1* | 5/2015 | Tervo | G05B 17/02 703/8 |
| 2015/0199471 | A1 | 7/2015 | Thorsteinsson | |
| 2017/0122236 | A1* | 5/2017 | Han | F02D 41/26 |
| 2018/0341729 | A1 | 11/2018 | Kowalyshyn et al. | |
| 2020/0240787 | A1 | 7/2020 | Jha et al. | |
| 2020/0401743 | A1 | 12/2020 | Bhattacharyya et al. | |
| 2021/0027225 | A1 | 1/2021 | Mikalsen et al. | |
| 2021/0070413 | A1 | 3/2021 | Gulliksson et al. | |

FOREIGN PATENT DOCUMENTS

| | | | |
|---|---|---|---|
| CN | 106335601 | A | 1/2017 |
| CN | 103688041 | B | 4/2017 |
| CN | 112381406 | A | 2/2021 |
| CN | 112562120 | A | 3/2021 |
| EP | 3795464 | A1 | 3/2021 |
| KR | 101451436 | B1 | 10/2014 |
| KR | 101661928 | B1 | 10/2016 |
| KR | 1020170069277 | A | 6/2017 |
| KR | 102232393 | B1 | 3/2021 |
| RU | 188729 | U1 | 4/2019 |
| WO | 2020025745 | A1 | 2/2020 |

* cited by examiner

SYSTEMS AND METHODS FOR OPTIMIZING VESSEL FUEL CONSUMPTION

FIELD

The described embodiments relate to engine management for seafaring vessels, and in particular to systems and methods for determining an engine configuration for a seafaring vessel having a plurality of thrust engines.

BACKGROUND

The following is not an admission that anything discussed below is part of the prior art or part of the common general knowledge of a person skilled in the art.

U.S. Pat. No. 10,370,063 of Skidmore purports to disclose a system configured to monitor energy usage of a surface maritime vessel. The system comprises a device configured to receive characteristic data representing at least one operating characteristic of the vessel and a device configured to receive model data representing at least one energy usage model for the vessel. The system further includes a device configured to process the characteristic data and the model data to generate an output representing a comparison between the characteristic data and the model data.

US Patent Publication No. 2021/0027225 of Mikalsen et al. purports to disclose a marine vessel advisory system configured to calculate and provide operational information that show fuel consumption savings based on adjustment of vessel speed and/or heading. In an embodiment, the advisory system may operate real-time to collect operational and/or environmental conditions information to be used to calculate alternative operational performance of the marine vessel that will save fuel and reduce emissions. The calculations may include a simulation, machine learning, and/or artificial intelligence to determine a speed and/or heading of the marine vessel that will reduce fuel consumption. The advisory system may display the computed information for the operator, and the operator may elect to switch to the alternative operating parameters (e.g., slower speed). In an embodiment, the advisory system may interact directly with a marine vessel system and automatically cause the marine vessel system to adjust operating parameters based on computed operating parameters that saves fuel and reduces emissions

SUMMARY

The following introduction is provided to introduce the reader to the more detailed discussion to follow. The introduction is not intended to limit or define any claimed or as yet unclaimed invention. One or more inventions may reside in any combination or sub-combination of the elements or process steps disclosed in any part of this document including its claims and figures.

The present disclosure allows for an optimized engine configuration to be determined for a seafaring vessel having a plurality of thrust engines. A seafaring vessel with multiple thrust engines can operate in multiple different engine configurations. Each engine configuration can include a specified number of thrust engines running with each engine running at a specified power output level. Each thrust engine may operate with a different fuel efficiency at different power output levels. Selecting an optimum engine configuration can help reduce the fuel consumption of the vessel while still ensuring that a voyage can be completed within the required time and routing constraints.

Vessel operational data and environmental data can be collected for the vessel using a plurality of onboard sensors. The collected data can be provided as inputs to a first machine learning model trained to generate the predicted required power for a given voyage. Using the predicted required power and the collected data, the predicted fuel consumption for various different engine configurations can be determined using engine-specific machine learning models for each thrust engine. The engine configuration corresponding to a desired predicted fuel consumption (e.g. the lowest predicted fuel consumption) can then be selected for the voyage. Operation of the vessel, and the individual thrust engines, can also be monitored over the course of the voyage to detect any deviations in the operations of the thrust engines. This can provide operators with feedback indicating that maintenance and/or repairs may be required to one or more thrust engines.

In accordance with a broad aspect, there is provided a method for determining an optimum engine configuration for a seafaring vessel having a plurality of thrust engines. The method comprises receiving vessel operational data and environmental data for a desired voyage, wherein at least some of the vessel operational data and environmental data is received from a plurality of sensors positioned onboard the vessel; determining a predicted required power by inputting the vessel operational data, the environmental data, and voyage data to a required power model, wherein the required power model is a first machine learning model trained to generate the predicted required power as an output, and the voyage data defines at least one characteristic of the desired voyage. The method further comprises determining an optimum engine configuration based on the predicted required power, wherein the optimum engine configuration is selected from a plurality of candidate engine configurations, wherein each candidate engine configuration includes a specified number of thrust engines running and a specified power output level of each thrust engine, and for each candidate engine configuration, a sum of power output from each of the thrust engines is at least equal to the predicted required power. The optimum engine configuration is selected by: for each candidate engine configuration, determining a candidate total predicted fuel consumption amount by—for each thrust engine running in that candidate engine configuration, determining an engine-specific predicted fuel consumption using an engine-specific fuel consumption model defined for that thrust engine, wherein each fuel consumption model includes a machine learning model configured to receive a power output level for the corresponding thrust engine as an input and to generate the engine-specific predicted fuel consumption by the corresponding thrust engine as an output; and determining the candidate total predicted fuel consumption amount as a sum of the engine-specific predicted fuel consumption determined for each running thrust engine; and selecting the optimum engine configuration from the candidate engine configurations based on the candidate total predicted fuel consumption of each candidate engine configuration.

The optimum engine configuration can be selected as the candidate engine configuration with the lowest candidate total predicted fuel consumption.

The method can include determining an optimum vessel trim by: inputting a vessel speed, a vessel average draft, and a plurality of potential vessel trim values to a vessel trim model, where the vessel trim model is a second machine learning model trained to output a total needed power value that represents an expected power needed from the plurality of thrust engines to provide the specific vessel speed, vessel average draft, and potential vessel trim value; and determining the optimum vessel trim as the potential vessel trim value that corresponds to a minimum total needed power value.

The method can include displaying the optimum engine configuration on an engine configuration user interface.

The method can include adjusting a power output level of one or more of the thrust engines to match the optimum engine configuration.

The method can include monitoring fuel consumption of the plurality of thrust engines; determining a difference between the candidate total predicted fuel consumption amount for the optimum engine configuration and the monitored fuel consumption; and displaying an indication of the difference on a fuel consumption user interface.

The method can include monitoring fuel consumption of the plurality of thrust engines; for a particular thrust engine, determining that the engine-specific predicted fuel consumption is different from the monitored fuel consumption; and adjusting the engine-specific fuel consumption model for that particular thrust engine.

The vessel operational data can include one or more of a current number of thrust engines running, a current power output from the running thrust engines, a vessel speed, a bow draft, and a stern draft.

The environmental data can include wind speed and/or wind direction data received from one or more of the plurality of sensors.

The voyage data can include one or more of a voyage distance, a voyage destination, a voyage route, or a required voyage time.

The vessel trim model can be a deep neural network.

For each thrust engine, the engine-specific fuel consumption model can be defined by: training the engine-specific fuel consumption model using a set of training data points defined based on the received vessel operational data and environmental data; where training the engine-specific fuel consumption model includes calibrating the engine-specific fuel consumption model using expected operational data for the corresponding thrust engine.

Calibrating the engine-specific fuel consumption model can include: identifying outlier data points in an initial set of data points from the received vessel operational data and environmental data; and omitting the outlier data points from the set of training data points used to train the engine-specific fuel consumption model.

Identifying the outlier data points can include: determining a corresponding Cook's distance for the initial set of data points; determining an average Cook's distance for the initial set of data points; and detecting the outlier data points as any data points having a corresponding Cook's distance greater than four times the average Cook's distance.

For each thrust engine, the engine-specific fuel consumption model can be defined by: generating a plurality of candidate fuel consumption models; determining at least one expected model characteristic; and defining the engine-specific fuel consumption model as the candidate fuel consumption model that best satisfies the at least one expected model characteristic.

The method can include determining the predicted required power by determining a plurality of potential predicted required power values for a corresponding plurality of potential vessel speeds by, for each potential predicted required power value, inputting the vessel operational data, the environmental data, and voyage data to the required power model, where each potential predicted required power value corresponds to a particular potential vessel speed and the vessel operational data for each potential predicted required power value includes the corresponding particular potential vessel speed; identifying a desired vessel speed from amongst the plurality of potential vessel speeds; and determining the predicted required power as the potential predicted required power value corresponding to the desired vessel speed.

The method can include selecting the particular potential vessel speed corresponding to the lowest potential predicted required power value as the desired vessel speed.

In accordance with a broad aspect, there is provided a system for determining an optimum engine configuration for a seafaring vessel having a plurality of thrust engines, the system comprising: a plurality of sensors positioned onboard the vessel; at least one processor; and at least one data storage unit storing a required power model and a plurality of fuel consumption models corresponding to the plurality of thrust engines, wherein the required power model is a first machine learning model trained to determine a predicted required power, and wherein each fuel consumption model includes a machine learning model configured to receive a power output level for the corresponding thrust engine as an input and to generate an engine-specific predicted fuel consumption by the corresponding thrust engine as an output; wherein the at least one processor is configured to: receive vessel operational data and environmental data for a desired voyage, wherein at least some of the vessel operational data and environmental data is received from the plurality of sensors; determine the predicted required power by inputting the vessel operational data, the environmental data, and voyage data to the required power model, wherein the voyage data defines at least one characteristic of the desired voyage; and determine an optimum engine configuration based on the predicted required power, wherein the optimum engine configuration is selected from a plurality of candidate engine configurations, wherein each candidate engine configuration includes a specified number of thrust engines running and a specified power output level of each thrust engine, and for each candidate engine configuration, a sum of power output from each of the thrust engines is at least equal to the predicted required power, wherein the optimum engine configuration is selected by: for each candidate engine configuration, determining a candidate total predicted fuel consumption amount by: for each thrust engine running in that candidate engine configuration, determining an engine-specific predicted fuel consumption using the engine-specific fuel consumption model defined for that thrust engine; and determining the candidate total predicted fuel consumption amount as a sum of the engine-specific predicted fuel consumption determined for each running thrust engine; and selecting the optimum engine configuration from the candidate engine configurations based on the candidate total predicted fuel consumption of each candidate engine configuration.

The at least one processor can be configured to select the optimum engine configuration as the candidate engine configuration with the lowest candidate total predicted fuel consumption.

The at least one data storage unit can store a vessel trim model, where the vessel trim model is a second machine learning model trained to output a total needed power value that represents an expected power needed from the plurality of thrust engines to provide a specific vessel speed, a vessel average draft, and a potential vessel trim value; and the at least one processor can be configured to determine an optimum vessel trim by: inputting the vessel speed, the vessel average draft, and a plurality of potential vessel trim values to a vessel trim model; and determining the optimum vessel trim as the potential vessel trim value that corresponds to a minimum total needed power value.

The at least one processor can be configured to display the optimum engine configuration on an engine configuration user interface.

The at least one processor can be configured to adjust a power output level of one or more of the thrust engines to match the optimum engine configuration.

The at least one processor can be configured to: monitor fuel consumption of the plurality of thrust engines; determine a difference between the candidate total predicted fuel consumption amount for the optimum engine configuration and the monitored fuel consumption; and display an indication of the difference on a fuel consumption user interface.

The at least one processor can be configured to: monitor fuel consumption of the plurality of thrust engines; for a particular thrust engine, determine that the engine-specific predicted fuel consumption is different from the monitored fuel consumption; and adjust the engine-specific fuel consumption model for that particular thrust engine.

The vessel operational data can include one or more of a current number of thrust engines running, a current power output from the running thrust engines, a vessel speed, a bow draft, and a stern draft.

The environmental data can include wind speed and/or wind direction data received from one or more of the plurality of sensors.

The voyage data can include one or more of a voyage distance, a voyage destination, a voyage route, or a required voyage time.

The vessel trim model can be a deep neural network.

For each thrust engine, the engine-specific fuel consumption model can be defined by: training the engine-specific fuel consumption model using a set of training data points defined based on the received vessel operational data and environmental data; where training the engine-specific fuel consumption model includes calibrating the engine-specific fuel consumption model using expected operational data for the corresponding thrust engine.

The engine-specific fuel consumption model can be calibrated by: identifying outlier data points in an initial set of data points from the received vessel operational data and environmental data; and omitting the outlier data points from the set of training data points used to train the engine-specific fuel consumption model.

The outlier data points can be identified by: determining a corresponding Cook's distance for the initial set of data points; determining an average Cook's distance for the initial set of data points; and detecting the outlier data points as any data points having a corresponding Cook's distance greater than four times the average Cook's distance.

For each thrust engine, the engine-specific fuel consumption model can be defined by: generating a plurality of candidate fuel consumption models; determining at least one expected model characteristic; and defining the engine-specific fuel consumption model as the candidate fuel consumption model that best satisfies the at least one expected model characteristic.

The at least one processor can be configured to determine the predicted required power by determining a plurality of potential predicted required power values for a corresponding plurality of potential vessel speeds by, for each potential predicted required power value, inputting the vessel operational data, the environmental data, and voyage data to the required power model, where each potential predicted required power value corresponds to a particular potential vessel speed and the vessel operational data for each potential predicted required power value includes the corresponding particular potential vessel speed; identifying a desired vessel speed from amongst the plurality of potential vessel speeds; and determining the predicted required power as the potential predicted required power value corresponding to the desired vessel speed.

The at least one processor can be configured to select the particular potential vessel speed corresponding to the lowest potential predicted required power value as the desired vessel speed.

In accordance with a broad aspect, there is provided a computer program product comprising a non-transitory computer readable medium storing computer executable instructions for configuring a processor to perform a method for determining an optimum engine configuration for a seafaring vessel having a plurality of thrust engines, wherein the method comprises: receiving vessel operational data and environmental data for a desired voyage, wherein at least some of the vessel operational data and environmental data is received from a plurality of sensors positioned onboard the vessel; determining a predicted required power by inputting the vessel operational data, the environmental data, and voyage data to a required power model, wherein the required power model is a first machine learning model trained to generate the predicted required power as an output, and the voyage data defines at least one characteristic of the desired voyage; and determining an optimum engine configuration based on the predicted required power, wherein the optimum engine configuration is selected from a plurality of candidate engine configurations, wherein each candidate engine configuration includes a specified number of thrust engines running and a specified power output level of each thrust engine, and for each candidate engine configuration, a sum of power output from each of the thrust engines is at least equal to the predicted required power, wherein the optimum engine configuration is selected by: for each candidate engine configuration, determining a candidate total predicted fuel consumption amount by: for each thrust engine running in that candidate engine configuration, determining an engine-specific predicted fuel consumption using an engine-specific fuel consumption model defined for that thrust engine, wherein each fuel consumption model includes a machine learning model configured to receive a power output level for the corresponding thrust engine as an input and to generate the engine-specific predicted fuel consumption by the corresponding thrust engine as an output; and determining the candidate total predicted fuel consumption amount as a sum of the engine-specific predicted fuel consumption determined for each running thrust engine; and selecting the optimum engine configuration from the candidate engine configurations based on the candidate total predicted fuel consumption of each candidate engine configuration The computer program product can include computer executable instructions for configuring a processor to perform a method for determining an optimum engine configuration for a seafaring vessel having a plurality of thrust engines, where the method is described herein.

It will be appreciated by a person skilled in the art that a device, method or computer program product disclosed herein may embody any one or more of the features contained herein and that the features may be used in any particular combination or sub-combination.

These and other aspects and features of various embodiments will be described in greater detail below.

BRIEF DESCRIPTION OF THE DRAWINGS

The drawings included herewith are for illustrating various examples of systems, methods, and devices of the teaching of the present specification and are not intended to limit the scope of what is taught in any way.

DESCRIPTION OF EXEMPLARY EMBODIMENTS

Figure 1:
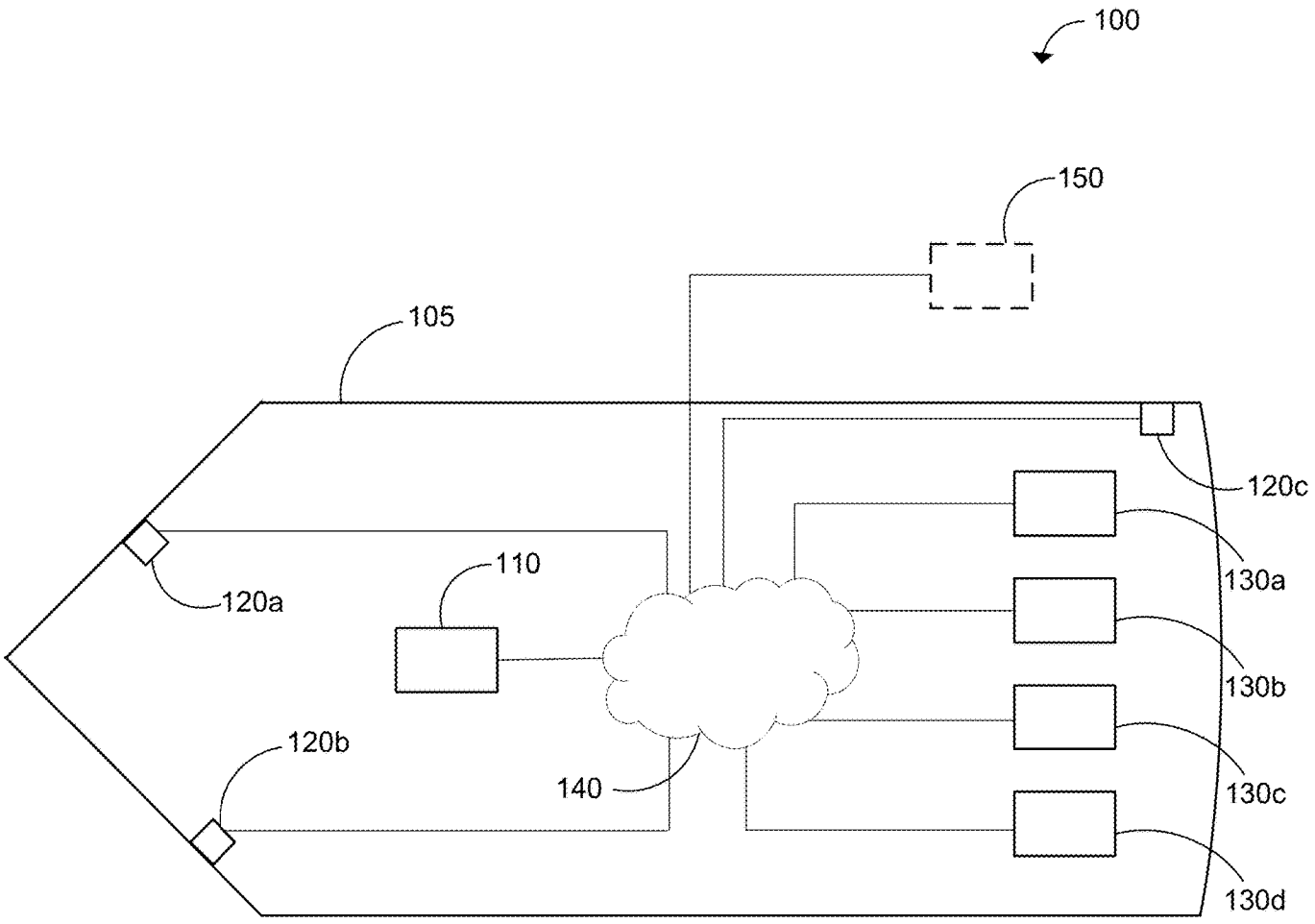
FIG. 1 shows a block diagram of an example system for determining an optimum engine configuration for a seafaring vessel having a plurality of thrust engines.

The drawings, described below, are provided for purposes of illustration, and not of limitation, of the aspects and features of various examples of embodiments described herein. For simplicity and clarity of illustration, elements shown in the drawings have not necessarily been drawn to scale. The dimensions of some of the elements may be exaggerated relative to other elements for clarity. It will be appreciated that for simplicity and clarity of illustration, where considered appropriate, reference numerals may be repeated among the drawings to indicate corresponding or analogous elements or steps.

In addition, numerous specific details are set forth in order to provide a thorough understanding of the embodiments described herein. However, it will be understood by those of ordinary skill in the art that the embodiments described herein may be practiced without these specific details. In other instances, well-known methods, procedures and components have not been described in detail so as not to obscure the embodiments described herein. Also, the description is not to be considered as limiting the scope of the embodiments described herein.

Various systems or methods will be described below to provide an example of an embodiment of the claimed subject matter. No embodiment described below limits any claimed subject matter and any claimed subject matter may cover methods or systems that differ from those described below. The claimed subject matter is not limited to systems or methods having all of the features of any one system or method described below or to features common to multiple or all of the apparatuses or methods described below. It is possible that a system or method described below is not an embodiment that is recited in any claimed subject matter. Any subject matter disclosed in a system or method described below that is not claimed in this document may be the subject matter of another protective instrument, for example, a continuing patent application, and the applicants, inventors or owners do not intend to abandon, disclaim or dedicate to the public any such subject matter by its disclosure in this document.

The terms "an embodiment," "embodiment," "embodiments," "the embodiment," "the embodiments," "one or more embodiments," "some embodiments," and "one embodiment" mean "one or more (but not all) embodiments of the present invention(s)," unless expressly specified otherwise.

In addition, as used herein, the wording "and/or" is intended to represent an inclusive-or. That is, "X and/or Y" is intended to mean X or Y or both, for example. As a further example, "X, Y, and/or Z" is intended to mean X or Y or Z or any combination thereof.

The terms "including," "comprising" and variations thereof mean "including but not limited to," unless expressly specified otherwise. A listing of items does not imply that any or all of the items are mutually exclusive, unless expressly specified otherwise. The terms "a," "an" and "the" mean "one or more," unless expressly specified otherwise.

It should be noted that terms of degree such as "substantially", "about" and "approximately" as used herein mean a reasonable amount of deviation of the modified term such that the end result is not significantly changed. These terms of degree may also be construed as including a deviation of the modified term if this deviation would not negate the meaning of the term it modifies.

It should also be noted that the terms "coupled" or "coupling" as used herein can have several different meanings depending in the context in which these terms are used. For example, the terms coupled or coupling may be used to indicate that an element or device can electrically, optically, or wirelessly send data to another element or device as well as receive data from another element or device.

Furthermore, any recitation of numerical ranges by endpoints herein includes all numbers and fractions subsumed within that range (e.g. 1 to 5 includes 1, 1.5, 2, 2.75, 3, 3.90, 4, and 5). It is also to be understood that all numbers and fractions thereof are presumed to be modified by the term "about" which means a variation of up to a certain amount of the number to which reference is being made if the end result is not significantly changed.

Further, although method steps may be described (in the disclosure and/or in the claims) in a sequential order, such methods may be configured to work in alternate orders. In other words, any sequence or order of steps that may be described does not necessarily indicate a requirement that the steps be performed in that order. The steps of methods described herein may be performed in any order that is practical. Further, some steps may be performed simultaneously.

Some elements herein may be identified by a part number, which is composed of a base number followed by an alphabetical or subscript-numerical suffix (e.g. 112*a*, or 1121). Multiple elements herein may be identified by part numbers that share a base number in common and that differ by their suffixes (e.g. 1121, 1122, and 1123). All elements with a common base number may be referred to collectively or generically using the base number without a suffix (e.g. 112).

The example systems and methods described herein may be implemented as a combination of hardware or software. In some cases, the examples described herein may be implemented, at least in part, by using one or more computer programs, executing on one or more programmable devices comprising at least one processing element, and a data storage element (including volatile memory, non-volatile memory, storage elements, or any combination thereof). These devices may also have at least one input device (e.g. a pushbutton keyboard, mouse, a touchscreen, and the like), and at least one output device (e.g. a display screen, a printer, a wireless radio, and the like) depending on the nature of the device.

It should also be noted that there may be some elements that are used to implement at least part of one of the embodiments described herein that may be implemented via software that is written in a high-level computer programming language such as object oriented programming. Accordingly, the program code may be written in C, C++ or any other suitable programming language and may comprise modules or classes, as is known to those skilled in object oriented programming. Alternatively, or in addition thereto, some of these elements implemented via software may be written in assembly language, machine language or firmware as needed. In either case, the language may be a compiled or interpreted language.

At least some of these software programs may be stored on a storage media (e.g. a computer readable medium such as, but not limited to, ROM, magnetic disk, optical disc) or a device that is readable by a general or special purpose programmable device. The software program code, when read by the programmable device, configures the programmable device to operate in a new, specific and predefined manner in order to perform at least one of the methods described herein.

Furthermore, at least some of the programs associated with the systems and methods of the embodiments described herein may be capable of being distributed in a computer program product comprising a computer readable medium that bears computer usable instructions for one or more processors. The medium may be provided in various forms, including non-transitory forms such as, but not limited to, one or more diskettes, compact disks, tapes, chips, and magnetic and electronic storage.

Many seafaring vessels operate using multiple thrust engines. Various engine configurations can be used to generate thrust for the vessels from the different thrust engines. Each engine configuration can include a specified number of thrust engines running with each engine running at a specified power output level. However, the fuel efficiency of each thrust engine can vary across different power output levels. The overall fuel efficiency of the vessel depends on the operating fuel efficiency of all the running thrust engines. Accordingly, for any given total power requirement, the overall fuel efficiency depends on the engine configuration, that is, which of the thrust engines are running and the power output level of the running thrust engines.

The total power required for a given voyage can be provided using different engine configurations, with differences in the number of running thrust engines and the corresponding power output levels. The different engine configurations may result in different overall fuel efficiencies, even while providing the same total power.

For any given total power requirement, the crew of a vessel may determine which engine configuration to use. However, selecting a sub-optimal engine configuration may result in excess fuel consumption without any meaningful improvement in other operational parameters, such as voyage time. Evaluating the efficiency of various engine configurations to identify an optimum engine configuration can help achieve better overall fuel efficiency for the vessel while still satisfying other operational parameters such as transit time and speed.

The present disclosure provides systems, methods and computer program products usable to determine an optimum engine configuration for a seafaring vessel having a plurality of thrust engines. In particular, the described systems, methods and computer program products can enable an engine configuration with the lowest total predicted fuel consumption to be automatically selected for a desired operating condition of the vessel.

The described systems, methods and computer program products can also provide vessel operators with meaningful information to allow the operator to evaluate multiple configuration options (e.g. multiple speed options for a given voyage distance) for a given voyage. This can enable the operator to make a data-driven decision when selecting a voyage speed for a specified journey based on trade-offs between travel time and fuel consumption.

The described systems, methods and computer program products can also facilitate monitoring and visualizing the fuel efficiency of a vessel's thrust engines over time. This can enable data-driven decisions regarding maintenance schedules (and possible repairs or replacement) for the thrust engines.

The described systems, methods and computer program products can also facilitate comparisons of actual fuel consumption versus predicted optimal fuel consumption for different vessel crews. This can enable data-driven decisions regarding intervention or training for vessel crews corresponding to much higher actual fuel consumption (compared with predicted optimal fuel consumption).

Referring now to FIG. 1, shown therein is a block diagram of an example system 100 for determining an optimum engine configuration for a seafaring vessel 105 having a plurality of thrust engines 130.

As shown in the example of FIG. 1, the vessel 105 includes a plurality of thrust engines 130*a*-130*d* (which may also be collectively referred to as engines 130). Each thrust engine 130 can generate propulsive thrust that can be used to move the vessel 105 through water.

Each thrust engine 130 can be operated independently. That is, the power output level of each thrust engine 130 can be set and adjusted individually. Collectively, the thrust engines 130 can be controlled to move the vessel 105 through water at a desired speed.

The system 100 also includes a control unit 110 and a plurality of sensors 120*a*-120*c* (which may also be collectively referred to as sensors 120) positioned onboard the vessel 105.

The control unit 110 typically includes a processing unit, an output device (such as a display, speaker, or tactile feedback device), a user interface, an interface unit for communicating with other devices, Input/Output (I/O) hardware, a wireless unit (e.g. a radio that communicates using CDMA, GSM, GPRS or Bluetooth protocol according to standards such as IEEE 802.11a, 802.11b, 802.11g, or 802.11n), a power unit and a memory unit. The memory unit can include RAM, ROM, one or more hard drives, one or more flash drives or some other suitable data storage elements such as disk drives, etc. An example control unit 110 is described in further detail herein below with reference to FIG. 2.

The control unit 110 can be communicatively coupled to the sensors 120 using a network 140. Network 140 may be any network or network components capable of carrying data including the Internet, Ethernet, fiber optics, satellite, mobile, wireless (e.g. Wi-Fi, WiMAX), SS7 signaling network, fixed line, local area network (LAN), wide area network (WAN), a direct point-to-point connection, mobile data networks (e.g., Universal Mobile Telecommunications System (UMTS), 3GPP Long-Term Evolution Advanced (LTE Advanced), Worldwide Interoperability for Microwave Access (WiMAX), etc.) and others, including any combination of these.

The control unit 110 can also be communicatively coupled to engines 130, for example using network 140. This may allow the control unit 110 to receive feedback data indicating the current operational conditions of the engines 130. Optionally, the control unit 110 may also be configured to adjust the operational settings of the engines 130. For example, control unit 110 may be configured to adjust the power output level of individual engines 130 in order to provide a desired engine configuration.

The control unit 110 can be configured to receive vessel operational data relating to the current operating conditions of the vessel 105 and components of the vessel 105 such as the engines. The control unit 110 can also be configured to receive environmental data relating to a desired voyage for the vessel. At least some of the vessel operational data and environmental data can be received from sensors 120. Optionally, some of the vessel operational data can be received from engines 130.

The control unit 110 can be configured to implement various methods relating to the operations and control of vessel 105, such as methods of determining an optimum engine configuration using the received vessel operational data and environmental data (as described in further detail herein below with reference to FIG. 3) and/or methods of determining an optimum vessel trim (as described in further detail herein below with reference to FIG. 4) and/or methods of determining a desired vessel speed (as described in further detail herein below with reference to FIG. 12).

In the example illustrated, control unit 110 is shown onboard vessel 105. Alternatively, the control unit 110 may be at a different location, e.g. provided by optional server 150. Alternatively, the functionality provided by the control unit 110 can be provided using both onboard components and components that are not located onboard the vessel 100 (e.g. components provided by server 150). Server 150 may be located remote from vessel 105 and may provide functionality as a cloud server. Control unit 110 can be configured to communicate with server 150 using network 140 or a different network.

Server 150 may be any networked computing device or system, including a processor and memory, and capable of communicating with a network, such as network 140. Server 150 may include one or more computing devices or systems that are communicably coupled to each other. The computing device may be a personal computer, a workstation, a server, a portable computer, or a combination of these.

Sensors 120 can be configured to collect vessel operational data and/or environmental data. The sensors 120 can provide the collected vessel operational data and/or environmental data to control unit 110.

Sensors 120 can include various sensors capable of collecting vessel operational data. The type of sensors 120 may vary depending on the operational data being collected. For example, sensors 120 can include sensors capable of monitoring and detecting vessel operational data such as vessel speed, current number of thrust engines running, current power output from the running thrust engines, bow draft, stern draft, vessel pitch, vessel heave and/or vessel roll.

Sensors 120 can include various sensors capable of collecting environmental data relating to a voyage for the vessel. The type of sensors 120 may vary depending on the environmental data being collected. For example, sensors 120 can include sensors capable of monitoring and detecting wind speed and/or wind direction that is impacting the vessel.

The sensors 120 can be configured to collect the vessel operational data and/or environmental data on an ongoing basis. For example, the sensors 120 can be configured to collect data on a continual basis (e.g. at regular intervals). Continually collecting data relating to the vessel operations can allow control unit 110 to monitor the operation of the vessel 105 and engines 130 to identify potential deviations from the expected operations (e.g. fuel consumption that is different from the predicted fuel consumption).

The control unit 110 can use the collected data to perform various processes on an ongoing basis, such as determining an updated engine configuration. The control unit 110 can adjust the engine configuration based on changes in the collected data, e.g. changes in the efficiency of a given thrust engine or changes in the environmental data resulting in a change to the required total power.

The control unit 110 can also provide feedback to the vessel operators relating to the operation of the vessel 105 and engines 130 based on the monitoring of the vessel operational data and/or environmental data. The control unit 110 may identify deviations from expected operations indicating that one or more engines 130 requires maintenance, repairs or replacement. This can provide a vessel operator with real-time feedback indicating the need for maintenance, repairs or replacement, so that the required work can be performed on a timely basis.

The sensors 120 can be configured to collect data at various intervals, depending on the configuration of sensors 120 and the control unit 110. For example, sensors 120 may collect data at a 1 Hz frequency. Alternatively, a longer or shorter collection period may be used depending on the needs of control unit 110. In some cases, different sensors may collect data at different intervals. For instance, sensors monitoring data that can change frequently (or where changes can significantly impact vessel operation) may be configured to collect data at shorter intervals than sensors monitoring data that is expected to change less frequently (or where the changes have a less significant impact on overall vessel operation). As an example, sensors 120 configured to collect data that is prone to frequent or rapid changes may collect data at a 1 Hz frequency while sensors configured to collect data that is less prone to frequent or rapid changes may collect data at a 1/60 Hz frequency.

Optionally, sensors 120 can be configured to collect data at different rates depending on the current operational mode of the vessel. For example, sensors collecting power output data of the thrust engines may collect data with a lower frequency (e.g. a 1/60 Hz frequency) when the vessel is idling and may collect data with a higher frequency (e.g. a 1 Hz frequency) when the vessel is in motion.

Sensor data collected by sensors 120 can be stored in non-volatile storage member of control unit 110 or server 150. This may allow for processing and analysis of the collected data over a period of time, allowing for both real-time processing and subsequent processing for review and analysis. The collected data can also be used to evaluate the methods implemented by control unit 110, e.g. to provide further training data for one or more machine learning models.

Figure 2:
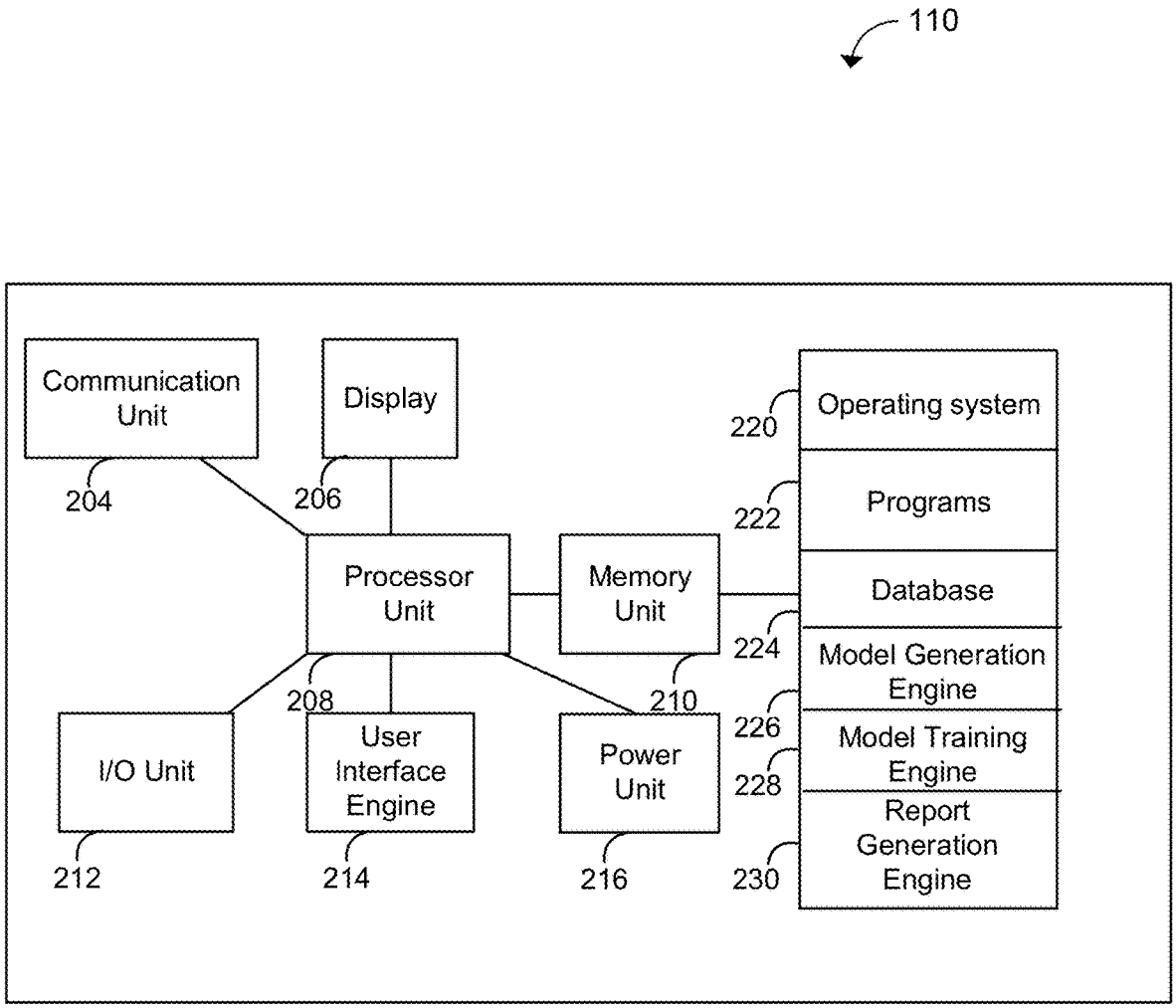
FIG. 2 shows a block diagram of an example control unit that may be used with the system of FIG. 1.

Referring now to FIG. 2, there is shown a block diagram of control unit 110 in accordance with an example embodiment. In the example illustrated, control unit 110 includes a communication unit 204, a display 206, a processor unit 208, a memory unit 210, an I/O unit 212, a user interface engine 214, and a power unit 216.

Communication unit 204 can include wired or wireless connection capabilities. Communication unit 204 can be used by control unit 110 to communicate with other devices or computers. For example, control unit 110 can use communication unit 204 to receive, via network 140, at least some of the vessel operational data and the environmental data from sensors 120. The control unit 110 can also use communication unit 204 to receive, via network 140, data indicating the current operational conditions of the engines 130.

Control unit 110 can use the communication unit 204 to transmit control instructions to various components of the vessel 105. For example, control unit 110 can transmit engine configuration settings (or changes in the engine configuration settings) to the engines 130 using communication unit 204. Control unit 110 may also receive vessel operational data, environmental data, and/or data indicating determined engine configurations from server 150 via communication unit 140.

Processor unit 208 can control the operation of control unit 110. Processor unit 208 can be any suitable processor, controller or digital signal processor that can provide sufficient processing power depending on the configuration, purposes and requirements of control unit 110 as is known by those skilled in the art. For example, processor unit 208 may be a high-performance general processor. For example, processor unit 208 may include a standard processor, such as an Intel® processor, or an AMD® processor. Alternatively, processor unit 208 can include more than one processor with each processor being configured to perform different dedicated tasks. Alternatively, specialized hardware can be used provide some of the functions provided by processor unit 208.

Processor unit 208 can execute a user interface engine 214 that is used to generate various user interfaces. User interface engine 214 may be configured to provide a user interface on display 206. Optionally, control unit 110 may be in communication with external displays via network 140. The user interface engine 214 may also generate user interface data for the external displays that are in communication with control unit 110.

User interface engine 214 can be configured to provide a user interface for displaying received vessel operational data and environmental data. The user interface can include data output display portions showing the measured values and indicators to signal if the measured values are outside of a normal operating range. The user interface may also include display portions showing predicted fuel consumption, determined optimum engine configuration or determined optimum trim, as described in further detail herein below with reference to FIGS. 5, 6, 8A-8D.

The user interface can also include user input portions operable receive input from users. For example, a user may input parameters of a desired voyage such as the voyage distance and the maximum voyage time. Alternatively, the user inputs can include inputs related to the engine configuration, such as changes to the engine configuration.

Display 206 may be a LED or LCD based display and may be a touch sensitive user input device that supports gestures. Display 206 may be integrated into control unit 110. In some embodiments, display 206 may be located physically remote from control unit 110 and communicate with control unit 110 using network 140. For example, display 206 may be located in a control room of a vessel while control unit 110 may be located in a remote location (e.g. provided by server 150).

I/O unit 212 can include at least one of a mouse, a keyboard, a touch screen, a thumbwheel, a trackpad, a trackball, a card-reader, voice recognition software and the like, depending on the particular implementation of control unit 110. In some cases, some of these components can be integrated with one another.

Power unit 216 can be any suitable power source that provides power to control unit 110 such as a power adaptor or a rechargeable battery pack depending on the implementation of control unit 110 as is known by those skilled in the art.

Memory unit 210 comprises software code for implementing an operating system 220, programs 222, database 224, model generation engine 226, model training engine 228, and report generation engine 230.

Memory unit 210 can include RAM, ROM, one or more hard drives, one or more flash drives or some other suitable data storage elements such as disk drives, etc. Memory unit 210 is used to store an operating system 220 and programs 222 as is commonly known by those skilled in the art. For instance, operating system 220 provides various basic operational processes for control unit 110. For example, the operating system 220 may be an operating system such as Windows® Server operating system, or Red Hat® Enterprise Linux (RHEL) operating system, or another operating system.

Database 224 may include a Structured Query Language (SQL) database such as PostgreSQL or MySQL or a not only SQL (NoSQL) database such as MongoDB, or Graph Databases, etc. Database 224 may be integrated with control unit 110. In some embodiments, database 224 may run independently on a database server in network communication (e.g., via network 140) with control unit 110.

Database 224 may store the received vessel operational data and environmental data. In some embodiments, control unit 110 may perform statistical analysis (e.g., mean, standard deviation, etc.) on some or all of the received data and store the results of the statistical analysis in database 224. Control unit 110 may use the stored results in determining outliers in the received data.

Database 224 may also store models generated by model generation engine 226. The models may include a required power model, engine-specific fuel consumption models, and/or a vessel trim model. Database 224 may further store results and predictions generated by the models. The stored results can be used to provide feedback reports, an example of which is described in further detail herein below with reference to FIG. 7.

Programs 222 include various programs so that control unit 110 can perform various functions such as, but not limited to, receiving vessel operational data and environmental data, generating models including a required power model, engine-specific fuel consumption models and/or a vessel trim model, determining predicted required power, determining optimum vessel trim, selecting an optimum engine configuration from multiple candidate engine configurations, providing output displays to users, and changing the engine configuration based on user input or to match a determined optimum engine configuration.

Model generation engine 226 may generate one or more machine learning models that can be used by the processing unit 208 to monitor vessel operations and/or control the engine configuration for the vessel. The machine learning models can include a required power model, engine-specific fuel consumption models and/or a vessel trim model for example. The machine learning models can be stored in the database 224.

The required power model can be defined to predict a total required power that is necessary to propel the vessel according to defined voyage constraints (e.g. a desired speed). The total required power can represent the combined power provided by all of the thrust engines necessary to propel the vessel forward. The required power model can be configured to receive vessel operational data, environmental data and voyage data as inputs. The required power model can be defined to output the predicted total required power in response to receiving the vessel operational data, environmental data and voyage data as inputs.

The vessel operational data provided as inputs to the required power model can include the number of thrust engines running, power output level of each of the running engines, vessel roll, vessel pitch, vessel heave, vessel bow draft, and the vessel stern draft for example.

The environmental data provided as inputs to the required power model can include wind speed and/or wind direction for example.

The voyage data provided as an input to the required power model can define at least one characteristic of a desired voyage for which the required power is being determined. The voyage data can include a voyage speed, a voyage distance, and a desired voyage time for example.

The desired voyage may be a voyage, trip or journey that an operator of the vessel would like the vessel to complete. The desired voyage may be defined as a journey or transit from a specific starting location to a specific destination location. The voyage data can be determined in various ways.

For instance, a user can input the starting location and the destination location to control unit 110 using I/O unit 212. Control unit 110 may then automatically determine the voyage distance based on the specified starting location and destination location (e.g., using maps stored in database 224 or using communication unit 204 to access GPS data). Alternatively, the user may define the voyage distance manually.

A user may also provide an input specifying a voyage speed to control unit 110 using I/O unit 212. Alternatively, the control unit 110 may determine the voyage speed (or at least a minimum voyage speed) automatically. For instance, a user may input a maximum travel time for the voyage. The control unit 110 can then determine the voyage speed based on the voyage distance and the maximum travel time. Optionally, the voyage speed may be further constrained by speed limitations for some or all of the voyage (e.g. as the vessel travels through a region that imposes a maximum speed). Accordingly, the control unit 110 may adjust the voyage speed for various portions of the voyage in response to the speed constraints.

Control unit 110 can be configured to automatically determine an optimized vessel speed to minimize the vessel's fuel consumption. For example, control unit 110 may use a required power model to predict total required power for a range of vessel speeds. The range of vessel speeds can include a set of speeds that are sufficient to complete the voyage in the desired voyage time. Control unit 110 can then select the vessel speed corresponding to the lowest predicted total required power as the optimized vessel speed.

Various different types of machine learning model (including linear and non-linear machine learning models) may be used to implement the required power model. For example, support vector machines, gradient boosted models, and polynomial regression models may be used.

As an example, the required power model can be implemented using a quadratic polynomial regression model. The quadratic polynomial regression model can be trained to output a predicted required power in response to receiving the operational data, environmental data, and voyage data. In one example, the operational data, environmental data, and voyage data provided as inputs to the quadratic polynomial regression model can include the current number of thrust engines running, a current power output from each running thrust engine, a vessel heave, a vessel trim, a vessel roll, a vessel pitch, a wind speed, a wind direction and a desired vessel speed.

The machine learning models (including the required power model, the engine-specific fuel consumption models and/or the vessel trim model) can be trained receive the vessel operational data and/or environmental data as different types of values. For example, the vessel operational data and/or environmental data may be provided as time-continuous inputs that includes a plurality of point-in-time values corresponding to each point in time or time step within a specified time period. This may provide more granular data for feedback and analysis with the trade-off of requiring increased computational expense. In such cases, the vessel operational data and/or the environmental data can be collected as time-continuous values that are input to the machine learning model.

Alternatively or in addition, vessel operational data values and/or environmental data values may be input to the machine learning models as individual point-in-time values.

Alternatively or in addition, vessel operational data values and/or environmental data values may be input to the machine learning models as aggregate values. The aggregate values can be determined based on the data collected by a sensor 120 over a specified time period. For example, the aggregate value may be determined as a maximum value and/or an arithmetic mean value of the data values collected over a specified time period. Determining aggregate values may provide the machine learning models with inputs that are more reflective of the conditions affecting the vessel, particularly for data (e.g. pitch, roll, heave) that has frequent local variations, but less frequent global variations (e.g. data that changes frequently and/or has a high deviation about a mean value). Using aggregate values may reduce model complexity and/or improve model accuracy by smoothing rapidly fluctuating data inputs.

Various different specified time periods may be used by the control unit 120 to determine the inputs to the machine learning models. For instance, a specified time period may range from about 30 seconds to 15 minutes. The specified time period may fall within a range of about 2 minutes to 10 minutes.

Optionally, the specified time period may be about 1 minute. Optionally, the specified time period may be about 2 minutes. Optionally, the specified time period may be about 5 minutes. Optionally, the specified time period may be about 10 minutes. Optionally, the specified time period may be about 15 minutes. Other statistical functions and time periods may also be used depending on the nature of the monitored data and the requirements of the particular machine learning model.

Optionally, a first subset of values can be provided as time-continuous input values to the machine learning model while a second subset of values is provided as aggregate input values to the machine learning model. For example, control unit 110 may provide aggregate values of the vessel pitch, vessel heave and vessel roll as inputs to the machine learning model while providing vessel speed and the power output of the thrust engines as time-continuous inputs to the required power model.

The machine learning model can be trained using training data that includes the set of inputs (e.g. a training number of thrust engines running, a training power output from each running thrust engine, a training vessel heave, a training vessel trim, a training vessel roll, a training vessel pitch, a training wind speed, a training wind direction and a training vessel speed). The training data can also include measured data representing the power required to operate at the desired voyage speed during operation of the vessel. For example, the required power for the vessel can be monitored over a training period when the vessel is operating. Once the machine learning model is trained using the training data, the machine learning model can be applied to determine the required power for the same vessel (or different vessels that are similar in configuration) in response to receiving the set of inputs.

The training process may vary depending on the type of machine learning model being implemented. For example, with a regression model, an optimization algorithm can be applied to optimize the regression coefficients implemented by the model. The optimization algorithm may employ a cost function based on the difference between the desired outputs (as calculated from the monitored required power) and the model outputs (as calculated from the given inputs).

Model generation engine 226 may generate an engine-specific fuel consumption model for each of the thrust engines. Each engine-specific fuel consumption model may be configured to receive a power output level for the corresponding thrust engine as an input. The engine-specific fuel consumption model may be further configured to generate the predicted fuel consumption for the corresponding thrust engine as an output. For example, an engine-specific fuel consumption model may generate a predicted fuel consumption of 205 g/kWh for a power output level of 1250 kW.

Various different types of machine learning model (including linear and non-linear machine learning models) may be used to implement the engine-specific fuel consumption model for each engine. For example, support vector machines, gradient boosted models, and polynomial regression models may be used. In some cases, different types of machine learning models may be used for individual engines (e.g. where more accurate results are achieved for a given engine using a different model type).

As an example, the engine-specific fuel consumption model can be implemented using a quadratic polynomial regression model and/or a 4th degree polynomial regression model. The regression model can be trained to output a predicted fuel consumption in response to receiving the power output level as an input.

The machine learning model can be trained using training data that includes training power output levels as an input. The training data can also include measured data representing the fuel consumption of the engine for a given power output level. For example, the fuel consumption of the engine can be monitored over a training period when the vessel is operating, and in particular as the engine operates at different power output levels. Once the machine learning model is trained using the training data, the machine learning model can be applied to determine the fuel consumption for the same engine in response to receiving the power output level as an input.

The training process may vary depending on the type of machine learning model being implemented. For example, with a regression model, an optimization algorithm can be applied to optimize the regression coefficients implemented by the model. The optimization algorithm may employ a cost function based on the difference between the desired outputs (as calculated from the monitored required power) and the model outputs (as calculated from the given inputs).

Control unit 110 can use the engine-specific fuel consumption models to predict the total fuel consumption for different engine configurations. For example, the potential power output level of a first thrust engine may be set to 1200 kW and the engine-specific fuel consumption model for the first thrust engine can generate a predicted fuel consumption of 200 g/kWh for the first thrust engine. The potential power output level of a second thrust engine can be set at a power output level of 1000 kW and the engine-specific fuel consumption model for the second thrust engine may generate a predicted fuel consumption of 210 g/kWh. Control unit 100 can use the engine-specific fuel consumption models for the first and the second thrust engine to generate a total predicted fuel consumption of 410 g/h for operating the first thrust engine at 1200 kW and operating the second thrust engine at 1000 kW. Examples of the engine-specific fuel consumption models are described in further detail herein below with reference to FIGS. 8A-8D.

Model generation engine 226 can also generate a vessel trim model. The vessel trim model can be configured to receive a vessel speed, vessel average draft and vessel trim value as inputs. The vessel trim model can be configured to output a total needed power value that represents an expected power needed from the plurality of thrust engines. The vessel trim model can be used in an iterative process to determine an optimum vessel trim that can reduce or minimize the expected power needed.

The vessel speed input can be defined in various ways, as described herein above. For example, the vessel speed input may be a desired speed for a given voyage and/or a current vessel speed.

The vessel average draft can be automatically determined by control unit 110. For example, the vessel average draft can be determined as the mean of the vessel bow draft and the vessel stern draft. Alternatively, the vessel average draft may be determined based on historical operational data for the vessel.

A range of potential vessel trim values may be provided as inputs to the vessel trim model as part of an iterative process for identifying an optimum vessel trim. The range of potential vessel trim values may vary based on the vessel and the vessel average draft (e.g. the range of realistic vessel trim values that may be used by the vessel in operation). For example, a vessel trim value input may include potential vessel trim values in a range from −0.8 to 0.4. In other example, the potential vessel trim values may include vessel trim values larger than 0.4 or smaller than −0.8.

Control unit 110 may use the vessel trim model to generate outputs of total needed power value for a range of vessel trim values corresponding to a specific vessel average draft and vessel speed input. Control unit 110 can use the vessel trim model to select an optimum vessel trim. For example, the optimum vessel trim may be selected as the vessel trim value corresponding to the lowest total needed power value.

Various different types of machine learning models may be used to implement the vessel trim model, such as a neural network model or deep neural network model for example.

As an example, the vessel trim model can be implemented using a deep neural network model. The deep neural network can be defined with 2 hidden layers, each with 64 nodes and a dropout layer with a dropout rate of 20% to prevent overfitting.

In the example described, the deep neural network model includes three layers. However, it should be understood that a greater or fewer number of layers may be used to provide the deep neural network model. Additionally, some of the layers may be modified or substituted. Furthermore, the number of nodes within a given layer can be varied in different implementations of the neural network model.

Alternatively, a different type of machine learning model (including linear machine learning models) could be used to determine the ground reaction force data, such as, for example a support vector machine, a gradient boosted decision tree, a regression model and so on.

The deep neural network model can be trained to output a total needed power in response to receiving the vessel trim, vessel speed and average draft as inputs.

The machine learning model can be trained using training data that includes the set of inputs (e.g. a training vessel trim, training vessel speed and training average draft). The training data can also include measured data representing the power required to operate at the training vessel speed with the training vessel trim and training average draft. For example, the required power for the vessel can be monitored over a training period when the vessel is operating. Once the machine learning model is trained using the training data, the machine learning model can be applied to determine the required power for the same vessel (or different vessels that are similar in configuration) in response to receiving the set of inputs.

The training process may vary depending on the type of machine learning model being implemented. The deep neural network can be fitted to the training data using an epoch (e.g. a number of times the training dataset is passed forward and backward through the neural network). For example, an epoch of 50 times may be used. Each iteration can be processed with a corresponding batch size (e.g. a batch size of 32 for example) and patience (number of additional epochs after the point that validation loss started to degrade, e.g. a patience of 5). A portion of the training data can be used as validation data (e.g. 10% of the training data).

Model generation engine 226 may generate multiple candidate models for each of the required power model, engine-specific fuel consumption models and/or the vessel trim model. Model generation engine 226 may use multiple criteria to select from among the generated candidate models. For example, model generation engine 226 may use the Mean Absolute Error (MAE) or Mean Absolute Percentage Error (MAPE) to determine model accuracy for the multiple candidate models and select the candidate model with the highest accuracy as the final model.

Alternatively or in addition, model generation engine 226 may select a candidate model with the lowest complexity as the final model. The complexity may be measured, for example, in terms of the computing resources consumed by the model during operation. This may be desirable in terms of providing real-time feedback to a vessel operator and/or control unit 110.

Alternatively, model generation engine 226 may use a combination of multiple criteria while selecting among the candidate models. For example, model generation engine 226 may use a minimum threshold accuracy to perform an initial selection among the candidate models and then use model complexity to perform the final selection. The model generation engine 226 may also use a weighted selection process in which the various criteria are weighted in order to select a desired candidate model.

Model training engine 228 may train the models generated by model generation engine 226. Although shown separately, model generation engine 226 and model training engine 228 may be implemented together as a combined model generation engine.

Model training engine 228 can train the required power model, the engine-specific fuel consumption models and/or the vessel trim model. Model training engine 228 may perform an initial training of the generated models using data collected by sensors 120 during an initial training period for the vessel.

Model training engine 228 may perform further training of the multiple models during regular operation of the vessel. For example, model training engine 228 may perform further training at regular time intervals. The regular time intervals may be based on a parameter stored in database 224 or provided by a user through I/O unit 212. Further training may also be performed at non-regular time intervals based on a user input received at I/O unit 212. Optionally, the multiple models may provide confidence scores for generated outputs and further training of a model may be performed based on its confidence score falling below a threshold confidence score.

Model training engine 228 can include received vessel operational data and environmental data in the training data used to perform training of the multiple models. Optionally, model training engine 228 may identify and remove outliers in the training data, as described in further detail herein below with reference to FIG. 11. Model training engine 228 may also calibrate the engine-specific fuel consumption models using expected operational data, as described in further detail herein below with reference to FIG. 11.

Report generation engine 230 may generate feedback reports based on outputs generated by the required power model, the engine-specific fuel consumption models and/or the vessel trim model. The generated reports can include the received vessel operational data and environmental data. Optionally, a report can include a suggested action for the user or operator of the vessel. For example, the report can include a recommended engine configuration for the vessel The reports may be based on real-time data or historical data stored in database 224. For example, report generation engine 230 can generate a comparison report showing monthly actual versus optimal fuel consumption by crew, as described in further detail herein below with reference to FIG. 7. Report generation engine 230 may also generate a report showing change in fuel efficiency of a specific engine over time, as described in further detail herein below with reference to FIG. 9. The feedback provided by report generation engine 230 can be used to implement changes or remedial action.

Figure 3:
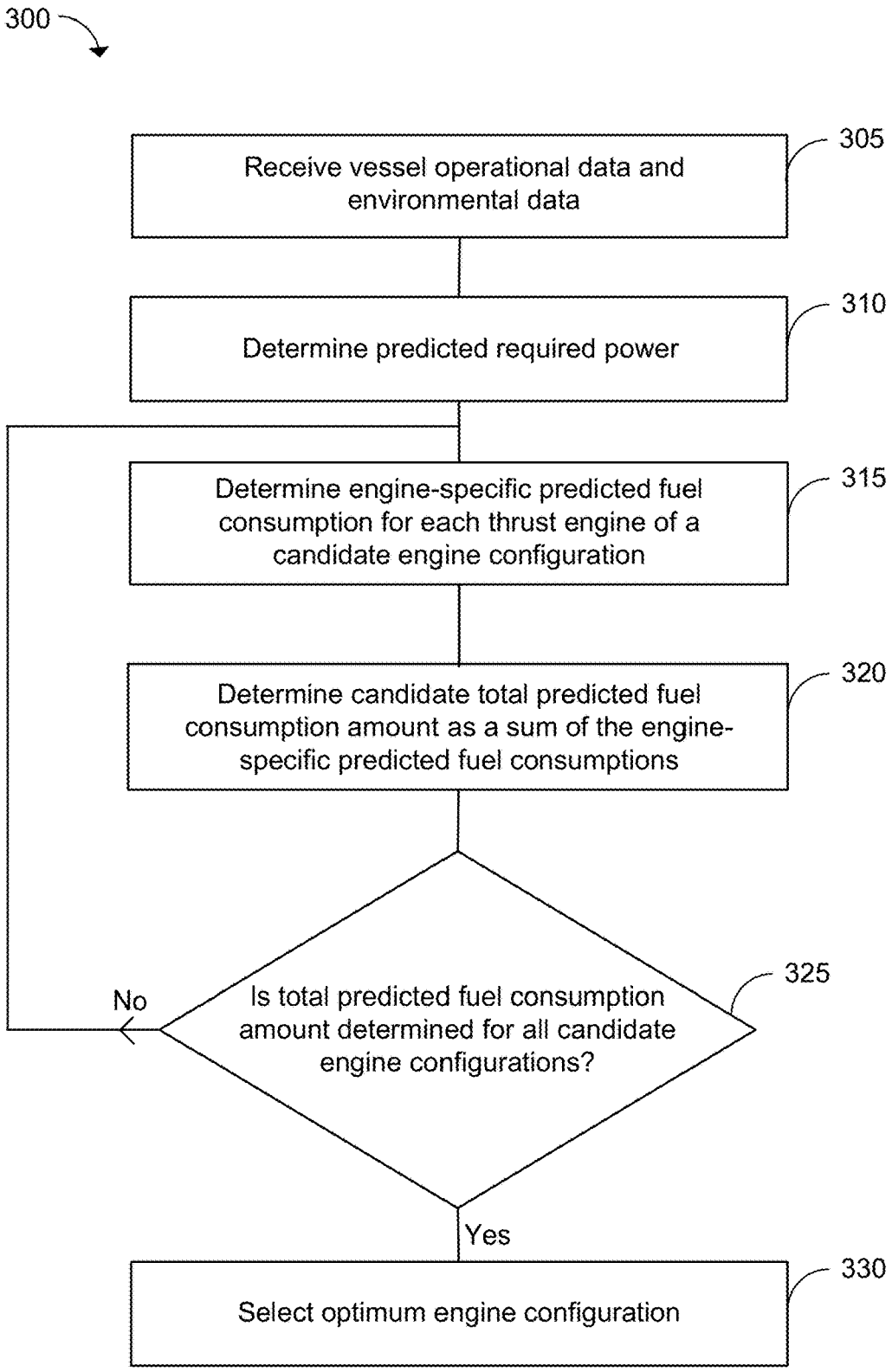
FIG. 3 is a flowchart illustrating an example process for determining an optimum engine configuration for a seafaring vessel having a plurality of thrust engines.

Referring now to FIG. 3, shown therein is a flowchart of an example method 300 for determining an optimum engine configuration for a seafaring vessel having a plurality of thrust engines. Method 300 can be implemented using a system for managing a seafaring vessel, such as system 100 for example.

Method 300 can be performed at various times relating to a voyage for a given seafaring vessel. For instance, the method 300 can be performed at the beginning of (or just prior to) a vessel's journey in order to determine an initial optimum engine configuration.

Optionally, method 300 can be performed repeatedly during the voyage to update the determination of the optimum engine configuration based on real-time data collected by sensors 120. For example, method 300 may be performed at regular time intervals during a journey to determine if the optimum engine configuration has changed compared with the previously determined optimum engine configuration. Alternatively or in addition, method 300 may be triggered in response to user input received at I/O unit 212 and/or in response to detected variations in the vessel operational data, environmental data, and/or voyage data.

At 305, vessel operational data and environmental data can be received for a desired voyage. Control unit 110 can receive vessel operational data and environmental data from sensors 120. For example, control unit 110 can receive the vessel operational data and environmental data from sensors 120 on a continual basis (e.g. at regular intervals). Alternatively or in addition, control unit 110 can receive vessel operational data and/or environmental data from an external source, such as server 150 and/or database 224.

The vessel operational data can include various types of data representing operational conditions of the vessel. The vessel operational data can include, for example, a current vessel speed, a current number of thrust engines running, a current power output from the running thrust engines, a bow draft, a stern draft, a vessel pitch, a vessel heave and/or a vessel roll. The vessel operational data may represent current operating conditions for the vessel. In some cases, the vessel operating conditions may be adjusted based on analysis of alternative operating conditions. For example, various vessel operating conditions (e.g. vessel speed and/or vessel trim) may be optimized according to desired operating conditions. An example method 400 of determining an optimum vessel trim is described herein below with reference to FIG. 4.

The environmental data can include various types of data relating to the environment through which the vessel is travelling and/or will be travelling. The environmental data can include wind speed and/or wind direction. Optionally, the environmental data can include additional environmental data such as sea conditions (e.g. a Beaufort scale).

The desired voyage may be a voyage, trip or journey that an operator of the vessel would like the vessel to complete. For example, the desired voyage may include the vessel travelling from a specific starting location to a specific destination location.

The control unit 110 can also receive voyage data corresponding to the desired voyage. The voyage data can represent characteristics or parameters of the desired voyage. For example, the voyage data can include a voyage route, a voyage distance (i.e. the distance between the specific starting location and the specific destination location), a desired travel time (e.g. a maximum time for the voyage to be completed), and/or vessel speed constraints for any portion of the journey.

The voyage data can be determined in response to user inputs provided to the control unit 110 through a user interface. As an example, a user may input a distance to be traveled in nautical miles and the desired voyage time range to travel the distance in.

At 310, a predicted required power can be determined. The predicted required power can represent the total power required to propel the vessel to perform the desired voyage according to the specified voyage conditions.

Control unit 110 can determine the predicted required power using a required power model. As explained herein above, the required power model can be a machine learning model (e.g. generated by model generation engine 226).

The required power model can be defined to determine a predicted required power in response to receiving the vessel operational data, the environmental data, and voyage data as an input. As described herein above, vessel operational data value and environmental data values may be input to the machine learning model in different forms, such as time-continuous inputs, individual point-in-time values and/or aggregate values.

As described herein above, the required power model can be trained using model training engine 228 to generate a predicted required power (provided by all the thrust engines combined) necessary to power the vessel forward for the conditions specified by the inputs.

Optionally, control unit 110 may provide a range of vessel speeds as input to the required power model. The range of vessel speeds can be provided using an iterative process during which the required power model determines a speed-specific required power for each vessel speed in the range of vessel speeds. The required power model can generate predicted required power for powering the vessel forward for the range of vessel speeds, given the vessel operational conditions and environmental conditions specified in the input data.

Control unit 110 may automatically determine the range of vessel speeds based on the voyage data. For example, control unit 110 may automatically determine the range of vessel speeds as the set of vessel speeds sufficient to satisfy the desired voyage conditions (e.g. based on a total voyage distance and travel time that the voyage needs to be completed in). Alternatively, the range of vessel speeds may be provided by a user using I/O unit 212.

Figure 12:
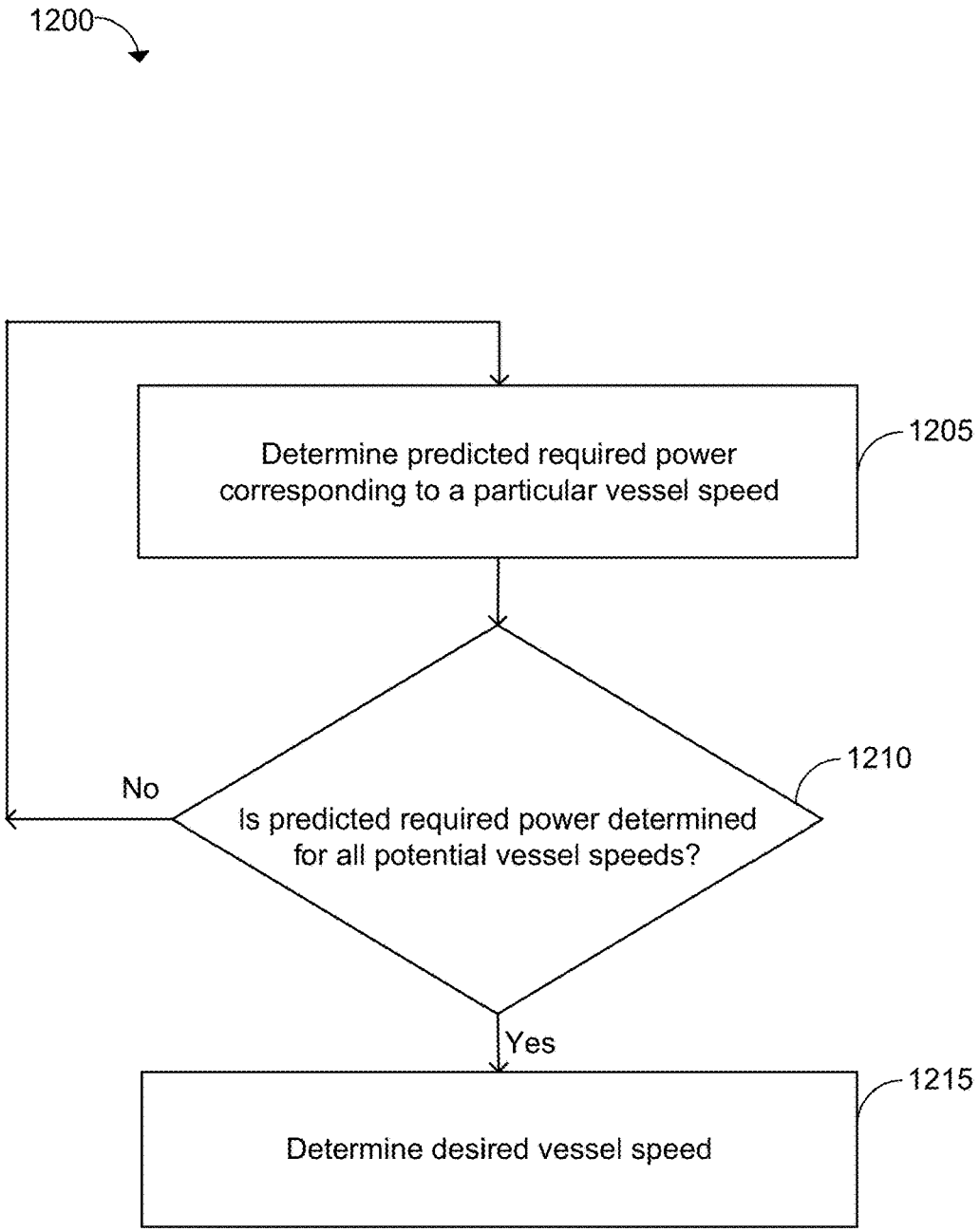
FIG. 12 is a flowchart illustrating an example process for determining a desired vessel speed for a seafaring vessel having a plurality of thrust engines.

Referring now to FIG. 12, shown therein is a flowchart of an example method 1200 for determining a desired vessel speed. For example, the desired vessel speed may be determined from a plurality of potential vessel speeds based on respective predicted required power values. The plurality of potential vessel speeds can be determined as a range of potential vessel speeds. The predicted required power at 310 may then be determined based on the predicted required power of the desired vessel speed.

At 1205, a predicted required power can be determined for a particular vessel speed value. The predicted required power can represent the total power required to propel the vessel at the particular vessel speed value, given the vessel operational conditions and environmental conditions (e.g. as determined from the data received at 305).

The particular vessel speed value may be selected from a range of vessel speeds suitable for the desired voyage (e.g. the range of vessel speeds that would allow the vessel to complete the voyage in a required time period).

Control unit 110 can determine the predicted required power using a required power model. As explained herein above, the required power model can be a machine learning model (e.g. generated by model generation engine 226).

At 1210, control unit 110 can determine whether the predicted required power has been determined for all of the potential vessel speeds. For example, control unit 110 may determine if the predicted required power at 1205 has been determined for the entire range of vessel speeds.

If there are any remaining vessel speed values, method 1200 can return to 1205. Control unit 110 can then determine the predicted required power by repeating step 1205 for the next potential vessel speed value.

If the predicted required power has been determined for all the potential vessel speeds method 1200 can proceed to 1215.

At 1215, a desired vessel speed can be determined. Control unit 110 can determine the desired vessel speed based on the predicted required power determined at 1205 for each of the potential vessel speed values.

Optionally, control unit 110 may identify the potential vessel speed value with the lowest predicted required power as the desired vessel speed. Traveling at the desired vessel speed may enable the vessel to minimize power consumption during the journey thereby also minimizing total fuel consumption during the journey.

Alternatively, control unit 110 may select another vessel speed value as the desired vessel speed. For example, control unit 110 may implement a multi-factor optimization algorithm to select a vessel speed that provides an optimized balance between voyage time and fuel consumption. The desired vessel speed and the corresponding predicted required power may then be used in process 300 to select an optimum engine configuration.

Referring back now to FIG. 3, at 315, an engine-specific predicted fuel consumption can be determined for each thrust engine of a candidate engine configuration. A candidate engine configuration can be defined as a specified number of thrust engines running with each thrust engine operating at a specified power output level. The control unit 110 can be configured to determine an engine-specific predicted fuel consumption for each thrust engine for a plurality of candidate engine configurations.

For example, for a vessel including four thrust engines, a first candidate engine configuration may include engine #1 running at 80% of rated power output level, engine #2 running at 75% of rated power output level and not running engine #3 and engine #4. Another candidate engine configuration may include engine #2 running at 80% of rated power output level, engine #3 running at 70% of rated power output level and not running engine #1 and engine #4.

Each candidate engine configuration can be defined to provide the required power determined at 310. That is, for each candidate engine configuration, the sum of power output from each of the thrust engines can be at least equal to the predicted required power determined at 310. For example, the predicted required power determined at 310 may be 5000 kW. Accordingly, each candidate engine configuration would be defined such that the sum of power output from all of the thrust engines is at least equal to 5000 kW. A first candidate engine configuration could include running three of the four thrust engines with engine #1 at 2000 kW, engine # 2 at 1500 kW and engine #3 at 500 kW. A second candidate engine configuration could include running all four thrust engines with engine #1 at 1400 kW, engine #2 at 1300 kW, engine #3 at 1300 kW and engine #4 at 1000 kW.

The fuel efficiency of each thrust engine can vary with the power output level of the thrust engine. At any specific power output level, the fuel efficiency (g/h) of a given thrust engine can equal the product of the power output (kW) and corresponding fuel consumption (g/kWh). Control unit 110 may determine the engine-specific predicted fuel consumption for each thrust engine of each candidate engine configuration using engine-specific fuel consumption models.

Control unit 110 can determine the engine-specific predicted fuel consumption for each thrust engine using a corresponding engine-specific fuel consumption model. As explained herein above, the engine-specific predicted fuel consumption model can be a machine learning model (e.g. generated by model generation engine 226).

The engine-specific predicted fuel consumption model can be defined to determine a fuel consumption in response to receiving the power output level as an input. As described herein above, the engine-specific predicted fuel consumption model can be trained using model training engine 228 to generate an engine-specific predicted fuel consumption model (provided by each thrust engine) based on the power level at which that engine is to operate.

At 320, a candidate total predicted fuel consumption amount can be determined as a sum of the engine-specific predicted fuel consumptions determined at 315. This can represent the predicted fuel consumption for the vessel if the vessel operates according to the selected candidate engine configuration.

For the example first candidate engine configuration described above, the total predicted fuel consumption amount for the first candidate engine configuration may be determined as the sum of the predicted fuel consumption for engine #1 operating at 2000 kW, engine #2 operating at 1500 kW and engine #3 operating at 500 kW.

At 325, it may be determined whether the total predicted fuel consumption amount at 320 has been determined for all candidate engine configurations. For example, control unit 110 may determine if the total predicted fuel consumption amount at 320 has been determined for all candidate engine configurations.

If there are any remaining candidate engine configurations, control unit 110 may determine the total predicted fuel consumption amount for the next remaining candidate engine configuration. Control unit 110 may determine the total predicted fuel consumption amount for the next remaining candidate engine configuration by repeating steps 315 and 320 (i.e. determining the engine-specific predicted fuel consumption for each thrust engine of the candidate engine configuration at 315 and then determining the candidate total predicted fuel consumption amount at 320 as describe herein above).

If the total predicted fuel consumption amount at 320 has been determined for all candidate engine configurations, then at 330, an optimum engine configuration can be selected. Control unit 110 can select the optimum engine configuration based on the candidate total predicted fuel consumptions determined at 320 for all the candidate engine configurations.

Control unit 110 may select the candidate engine configuration with the lowest candidate total predicted fuel consumption as the optimum engine configuration. Alternatively, the control unit 110 may select another candidate engine configuration as the optimum engine configuration. For example, the control unit 110 may implement a multi-factor optimization algorithm to select a candidate engine configuration that provides an optimized balance between voyage time and fuel consumption.

The control unit 110 can then output the optimum engine configuration determined at 330.

Optionally, control unit 110 can output a display indicating the optimum engine configuration determined at 330. The control unit 110 may also output an engine configuration message or prompt. The engine configuration prompt may prompt a user to select or approve the optimum engine configuration determined at 330. The control unit 110 may then adjust the current engine configuration in response to the user approving the optimum engine configuration. Control unit 110 can transmit a command to engines 130 using communication unit 204 in order to change the engine configuration.

Alternatively or in addition, control unit 110 can automatically change the current engine configuration of the vessel to match the selected optimum engine configuration.

Alternatively or in addition, control unit 110 can store the selected optimum engine configuration and the corresponding total predicted fuel consumption in database 224 or server 150. This may allow the required power model and/or engine-specific fuel consumption models to be evaluated after monitoring the operation of the vessel at the optimum engine configuration.

Figure 4:
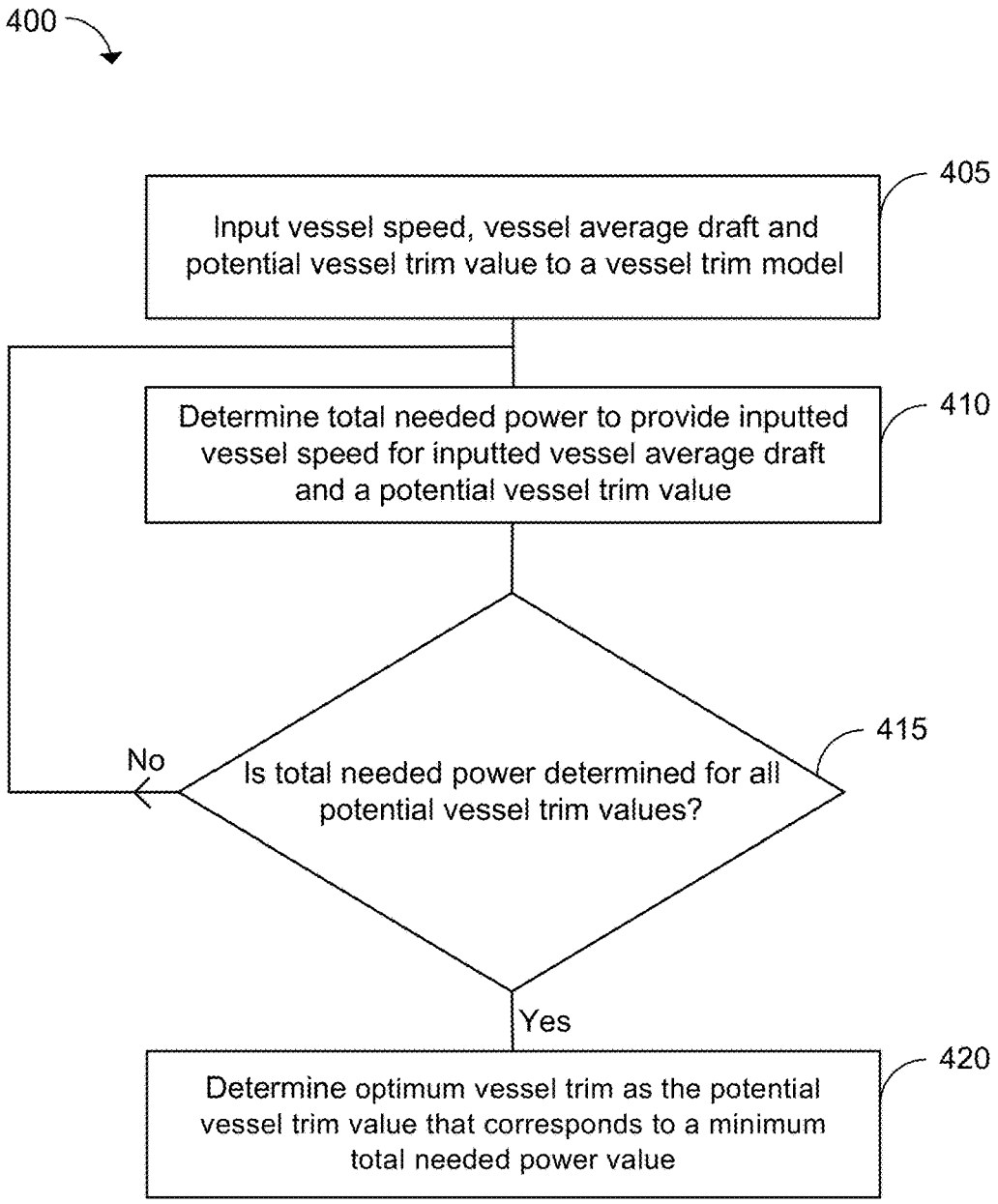
FIG. 4 is a flowchart illustrating an example process for determining an optimum vessel trim.

Referring now to FIG. 4, shown therein is a flowchart of an example process 400 for determining an optimum vessel trim for a seafaring vessel. Method 400 can be implemented using a system for managing a seafaring vessel, such as system 100 for example.

Method 400 can be used as an independent method for determining an optimum vessel trim. Alternatively, method 400 can be used in conjunction with method 300 described herein above. For example, method 400 can be used to determine an optimum vessel trim that can be provided as an input to the required power model at 310.

Method 400 can be performed at various times relating to a voyage for a given seafaring vessel. For instance, the method 400 can be performed at the beginning of (or just prior to) a vessel's journey in order to determine an initial optimum vessel trim.

Optionally, method 400 can be performed repeatedly during the voyage to update the determination of the optimum vessel trim based on real-time data collected by sensors 120. For example, method 400 may be performed at regular time intervals during a journey to determine if the optimum vessel trim has changed compared with the previously determined optimum vessel trim. Alternatively or in addition, method 400 may be triggered in response to user input received at I/O unit 212 and/or in response to detected variations in the vessel operational data, environmental data, and/or voyage data.

At 405, vessel speed, vessel average draft and a potential vessel trim value can be provided as inputs to a vessel trim model. The vessel trim model can be defined to determine an estimated power required in response to receiving the vessel speed, vessel average draft and potential vessel trim value as inputs. As described herein above, the vessel trim model can be trained using model training engine 228 to generate an estimated power required (provided by all the thrust engines combined) necessary to power the vessel forward for the conditions specified by the inputs.

The vessel speed input can be determined based on the current vessel speed and/or a desired vessel speed for a given voyage. For example, the vessel speed may be determined as an optimum vessel speed as described herein above using method 1200 at step 310 of method 300.

The vessel average draft can be automatically determined by control unit 110. For example, the vessel average draft can be determined as the mean of the vessel bow draft and the vessel stern draft. Alternatively, the vessel average draft may be determined based on historical operational data for the vessel.

The potential vessel trim value may be selected from a range of potential vessel trim values. The trim values withing the range of potential vessel trim values can be provided as inputs to the vessel trim model as part of an iterative process for identifying an optimum vessel trim.

The range of vessel trim values can be defined based on the range of trim values that can be practically achieved for the vessel given the corresponding vessel stern draft and vessel bow draft (e.g. the range of realistic vessel trim values that may be used by the vessel in operation). The vessel may include means for adjusting the stern draft and the bow draft. The range of potential vessel trim values can be defined to account for the level of trim adjustment possible for the vessel.

For example, the vessel may include one or more liquid storage tanks. Bulk liquids (for example, fuel, ballast, pot water etc.) may be transferable between the storage tanks to adjust the trim of the vessel. The level of adjustment possible for a given vessel can vary depending on the nature, size and locations of the storage tanks relative to the vessel stern and vessel bow, and the quantity of bulk liquids that may be pumped into or out of the tanks.

Optionally, control unit 110 can standardize the input data (vessel speed, vessel average draft and potential vessel trim values) before providing the input data to the vessel trim model. For example, the input data may be standardized by transforming the values corresponding to each of vessel speed, vessel average draft and vessel trim to have a mean value of 0 and a standard deviation of 1. Other standardization methods may be used.

At 410, the total needed power can be determined based on the vessel speed, the vessel average draft and the potential vessel trim value received at 405. Control unit 110 can use the vessel trim model to determine the total power needed to propel the vessel forward at the input vessel speed given the vessel draft and the potential vessel trim value received at 405.

At 415, control unit 110 can determine whether the total needed power has been determined for all potential vessel trim values. That is, control unit 110 can determine whether all of the vessel trim values in the plurality of potential vessel trim values have been evaluated.

If there are any remaining potential vessel trim values, control unit 110 can return to 405 and determine the corresponding total needed power for the next remaining potential vessel trim value.

If the total needed power has been determined for all the potential vessel trim values, then at 420, an optimum vessel trim can be determined. Control unit 110 can select the optimum vessel trim based on the total need power determined at 410 for all the potential vessel trim values.

Control unit 110 may select the optimum vessel trim as the potential vessel trim value that corresponds to a minimum total needed power value.

Alternatively, the control unit 110 may select another potential vessel trim value as the optimum vessel trim value. For example, the control unit 110 may implement a multi-factor optimization algorithm to select a potential vessel trim value that provides an optimized balance between power needed and adjustments to liquid storage units.

The control unit 110 can then output the optimum vessel trim determined at 420.

Optionally, control unit 110 can output a display indicating the optimum vessel trim determined at 420. The control unit 110 may also output an optimum vessel trim message or prompt. The optimum vessel trim prompt may prompt a user to select or approve the optimum vessel trim determined at 420. The control unit 110 may then adjust the trim of the vessel in response to the user approving the optimum vessel trim. Control unit 110 can transmit a command to the storage tanks (or associated pumps) using communication unit 204 in order to change the vessel trim.

Alternatively or in addition, control unit 110 can automatically change the trim of the vessel to match the optimum vessel trim.

Alternatively or in addition, control unit 110 can store the selected optimum vessel trim and the corresponding total power needed in database 224 or server 150. This may allow the vessel trim model to be evaluated after monitoring the operation of the vessel at the optimum vessel trim.

Alternatively or in addition, control unit 110 can use the optimum vessel trim as an input to a required power model (e.g. at step 310 of method 300).

Figure 5:
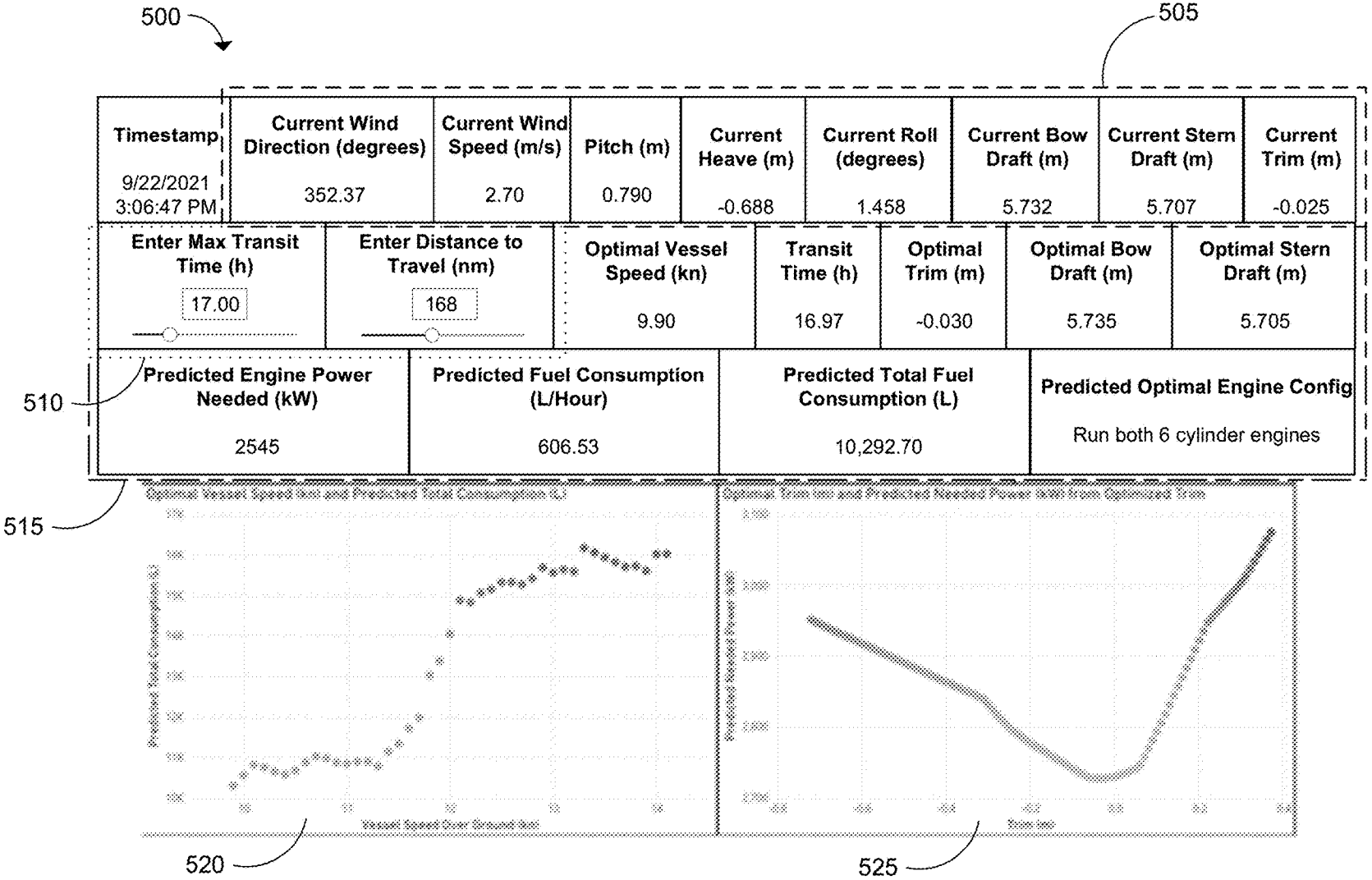
FIG. 5 illustrates an example of an interactive engine configuration display.

Referring now to FIG. 5, shown therein is an example of an interactive engine configuration display 500. Display 500 is an example of a graphical user interface (GUI) that may be generated, for example, by user interface engine 214 of control unit 110. Display 500 may be provided on display 206. Alternatively or in addition, display 500 may be provided at a remote location, for example, at an onshore location remote from the vessel.

As illustrated, display 500 includes multiple display regions or portions 505, 510, 515, 520, and 525. One or more of portions 505, 510, 515, 520, and 525 can include interactive portions that may receive a user input via, for example, a touchscreen display.

Portion 505 can display vessel operational data and environmental data, for example, data received from sensors 120. Portion 505 can provide a real-time display of data received from sensors 120. Alternatively or in addition, the displayed data may correspond to the vessel operational data and environmental data used by method 300 and/or method 400 to determine an optimum engine configuration and/or optimum vessel trim.

Portion 510 can provide an interactive interface that enables a user to provide input data. The input data can then be used by the control unit 110 to perform various operations, such as determining the required power for a desired voyage. For example, portion 510 may allow a user to provide voyage data to control unit 110. As shown, the user can provide a "Distance to Travel" (nautical miles) and a "Max Transit Time" (h) using the interactive interface provided by portion 510.

Portion 515 can provide displays of the outputs generated by the required power model, the engine-specific fuel consumption models, and/or the vessel trim model. This may allow a user to adjust the operating conditions of the vessel based on the data generated by control unit 110 (e.g. through methods 300 and/or 400 described herein above).

In the example illustrated, portion 515 displays the optimum vessel speed and the predicted required power corresponding to the vessel operational data and environmental data displayed in portion 505 and the voyage data input via portion 510. The optimum vessel speed and the predicted required power can be determined using as implementation of method 300 described herein above. For example, the optimum vessel speed and the predicted required power may be determined at 310 of process 300. This may prompt a user to change (or approve an automated change to) the current vessel speed based on the displayed optimum vessel speed.

Portion 515 may also provide a display of a predicted optimum engine configuration. The optimum engine configuration can be determined, for example, by control unit 110 at step 330 of process 300 as described herein above. This may prompt a user to change (or approve an automated change to) the current engine configuration of the vessel based on the displayed optimum engine configuration.

As illustrated, portion 515 can also provide a display of a predicted fuel consumption amount (liters/hour) for the optimum engine configuration. The predicted fuel consumption amount (liters/hour) may correspond to the determined candidate total predicted fuel consumption at 320 of process 300 for the candidate engine configuration selected as the optimum engine configuration.

As illustrated, portion 515 can also include a display of the predicted total fuel consumption (liters) for the entire journey. The predicted total fuel consumption (liters) may be determined by control unit 110, based on the voyage data and the predicted fuel consumption amount (liters/hour) for the optimum engine configuration.

As illustrated, portion 515 can also include a display of the optimum vessel trim and the corresponding optimal bow draft and the optimal stern draft. The optimum vessel trim may be determined, for example, at 420 of process 400. This may prompt a user to change (or approve an automated change to) the current vessel trim value by controlling the pumping of bulk liquids into or out of corresponding tanks as described herein above.

As illustrated, portion 520 can include a plot of the predicted total fuel consumption for a journey versus vessel speed. For example, control unit 110 may determine an optimum engine configuration and corresponding predicted total fuel consumption using process 300 for a range of vessel speeds. The range of vessel speeds may be provided by a user or may be automatically determined by control unit 110 based on the voyage data. This may allow a vessel operator to select a vessel speed that provides a desired trade-off between travel time and fuel efficiency.

As illustrated, portion 525 can include a plot of the predicted total needed power for a range of potential vessel trim values. For example, control unit 110 may determine the predicted total needed power using the vessel trim model, as described herein above with reference to process 400, for a range of potential vessel trim values.

Figure 6:
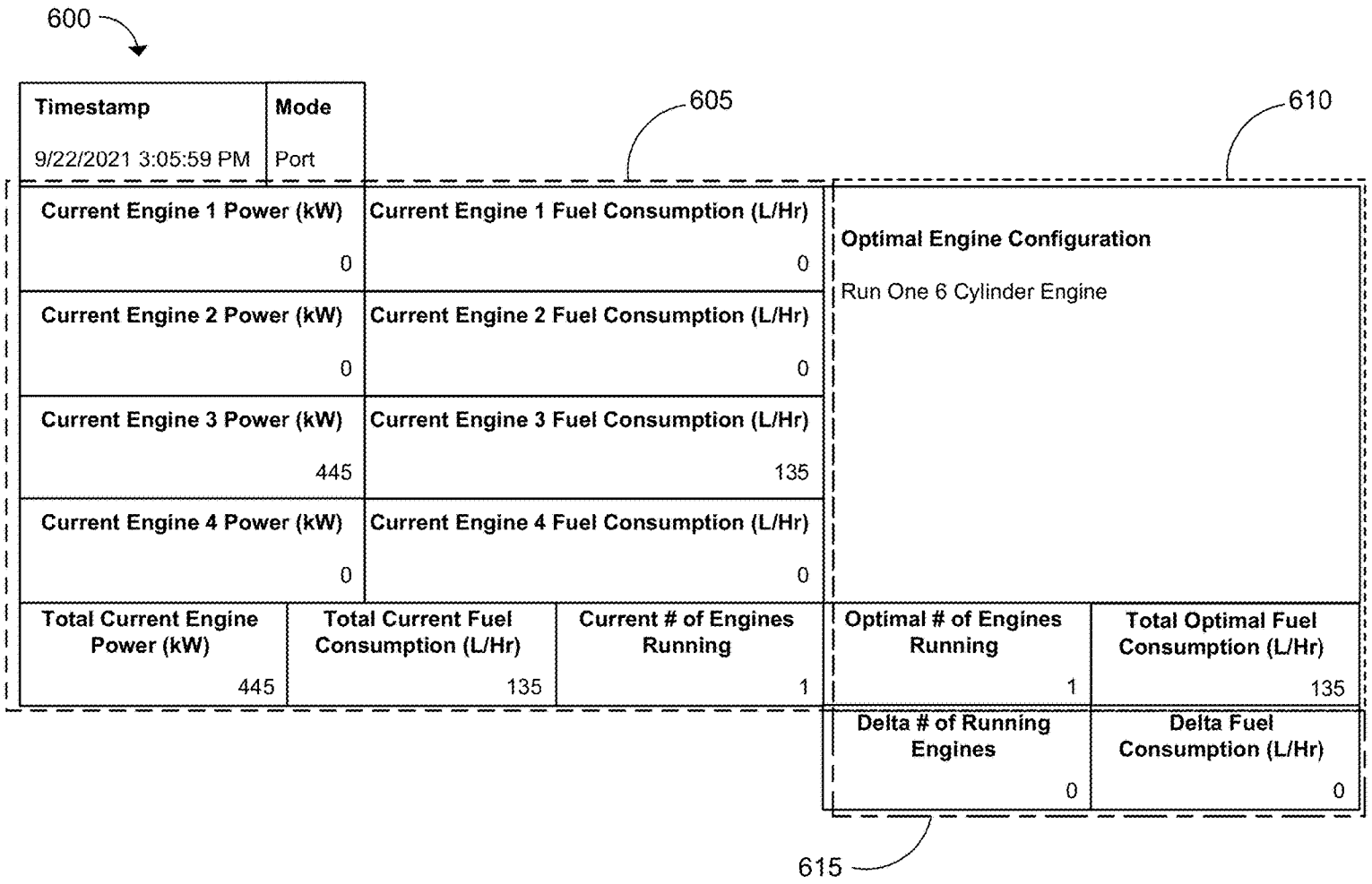
FIG. 6 illustrates an example of a real-time engine configuration display.

Referring now to FIG. 6, shown therein is an example of a real-time engine configuration display 600, in accordance with an embodiment. Display 600 is an example of a graphical user interface (GUI) that may be generated, for example, by user interface engine 214 of control unit 110. Display 600 may be provided on display 206. Alternatively or in addition, display 600 may be provided at a remote location, for example, at an onshore location remote from the vessel.

As illustrated, display 600 includes multiple display regions or portions 605, 610, and 615. One or more of portions 605, 610, and 615 can include interactive portions that may receive a user input via, for example, a touchscreen display.

Portion 605 can display the current engine output power and current engine fuel consumption for each thrust engine of a vessel. Portion 605 can also display the corresponding current number of engines running, total current engine power and total current fuel consumption. In the example illustrated, portion 605 illustrates data corresponding to each of four thrust engines.

The current engine fuel consumption may be based on data received from sensors measuring marine diesel oil (MDO) consumption of the engine. Alternatively, the current engine fuel consumption may be generated based on the output power level of the engine and the engine-specific fuel consumption model.

Portion 610 can display a predicted optimum engine configuration based on the total current engine power. For example, control unit 110 may generate candidate engine configurations where the sum of power output from each of the thrust engines is at least equal to the total current engine power (instead of the predicted required power determined at 310 of process 300). Control unit 110 may then determine total predicted fuel consumption amounts for all the candidate engine configurations and select a predicted optimal engine configuration in a manner analogous to that described above herein corresponding to 315-330 of process 300. Portion 610 can also display the optimal number of engines running corresponding to the predicted optimum engine configuration and the corresponding optimal total predicted fuel consumption amount.

Portion 615 can display a difference between the current and predicted optimum number of engines running and the corresponding difference between the current fuel consumption and the predicted optimum fuel consumption. This may prompt a user to adjust the current operating conditions of the vessel. Optionally, display 600 can include an input or prompt to allow a user to adjust the engine configuration to match the predicted optimum engine configuration.

Figure 7:
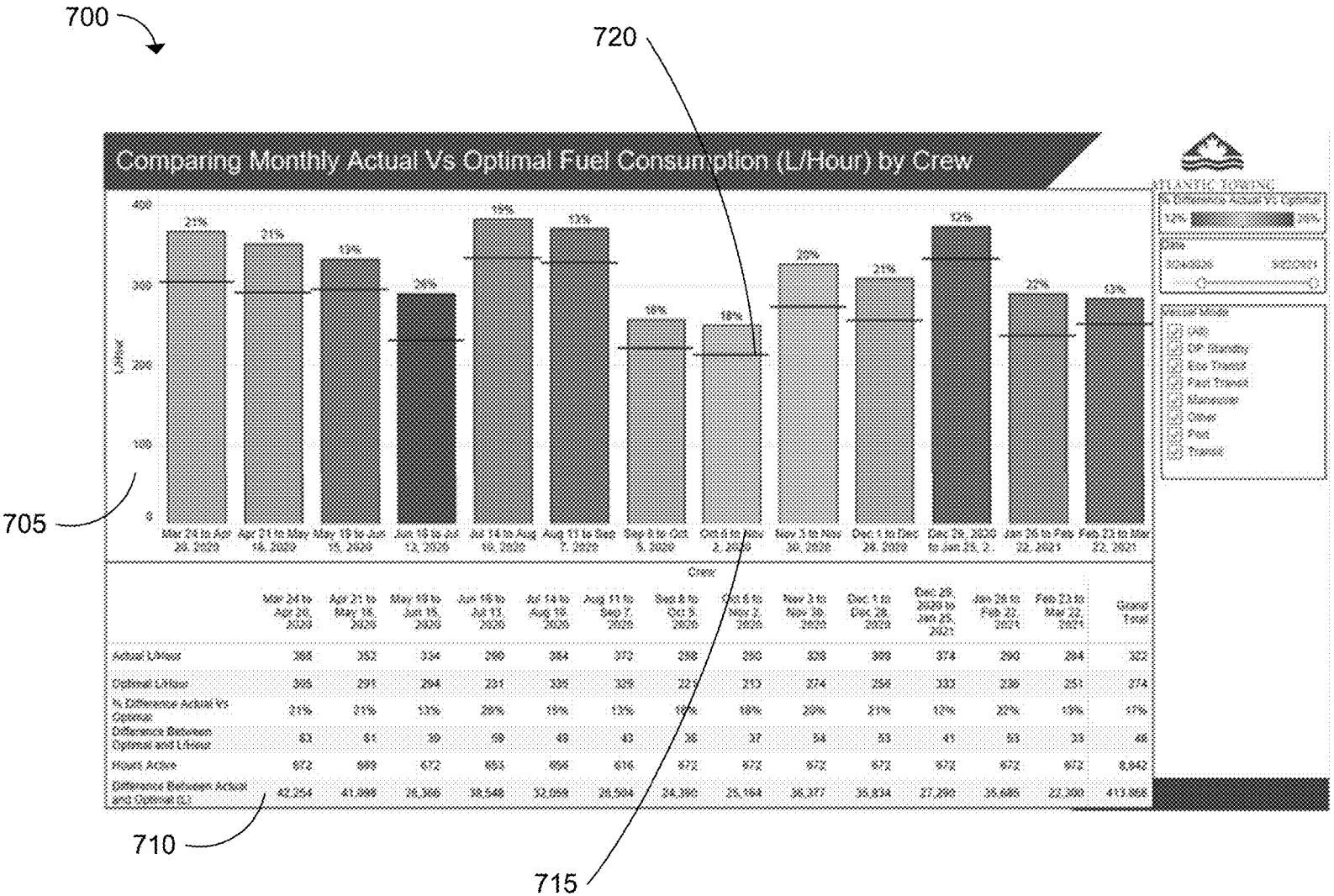
FIG. 7 illustrates an example report display comparing monthly total actual fuel consumption amount versus optimal total predicted fuel consumption amount by vessel crew.

Referring now to FIG. 7, shown therein is an example report interface 700. Report interface 700 provides feedback data that provides a comparison of the monthly total actual fuel consumption amount versus optimum total predicted fuel consumption amount for a plurality of different vessel crews.

The monthly total actual fuel consumption amount can be determined based on a total sum of actual fuel consumption of each thrust engine. The actual fuel consumption of each thrust engine may be determined based on data received from sensors measuring MDO consumption of each thrust engine.

The monthly optimum fuel consumption amount may be determined based on, for example, total predicted fuel consumption amount determined by control unit 110 for the optimum engine configuration using process 300. Control unit 110 may determine a difference between the total actual fuel consumption amount and the total predicted fuel consumption amount for the optimum engine configuration. The determined difference may be displayed in report 700, e.g. in graph portion 705 and/or table portion 710.

Report 700 may be used to evaluate fuel efficiency performance of various crews. As illustrated, report 700 shows that vessel crew 715 consumed 20% more fuel compared with predicted optimal fuel consumption level 720. This feedback interface may be used to implement remedial actions for crews whose operations fall outside of acceptable operating parameters.

Referring now to FIGS. 8A-8D, shown therein are example plots of predicted fuel consumption generated by engine-specific fuel consumption models for a plurality of engines. FIGS. 8A-8D illustrate example predicted fuel consumption for four Rolls Royce Bergen engines of a seafaring vessel.

Figure 8A:
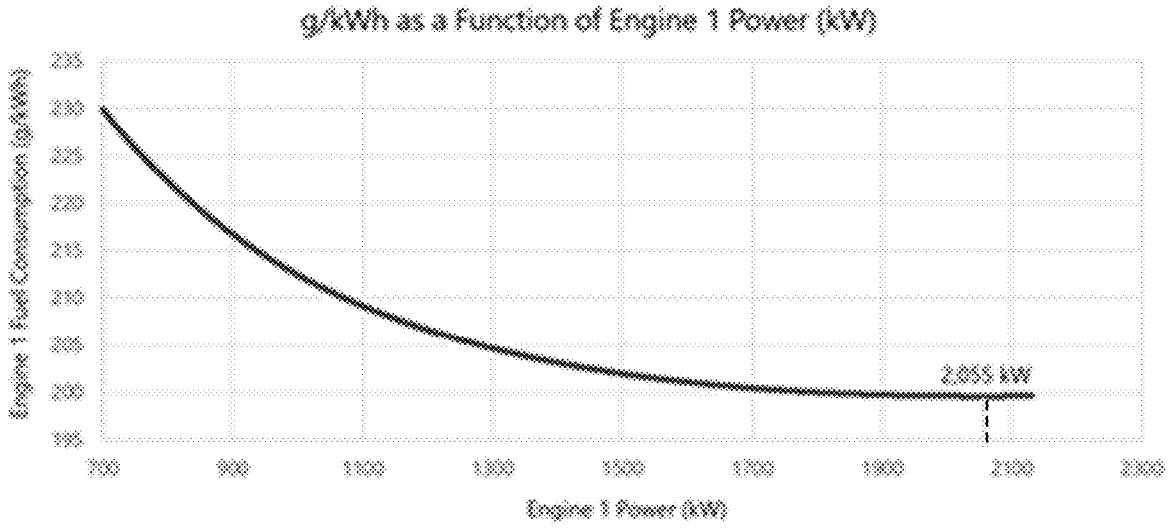
FIGS. 8A-8D illustrate example graphs showing predicted fuel consumption outputs generated by engine-specific fuel consumption models.

FIG. 8A shows predicted fuel consumption versus engine power output for the engine #1. The corresponding engine-specific fuel consumption model may be expressed as—

$$f(P_1)\frac{g}{\text{kWh}} = \frac{48959.3}{P_1} + 151.85 + 0.0116P_1$$

Using the first derivative of the model equation, the minimum fuel consumption for engine #1 can be determined to occur at 2,055 kW or approximately 80% of engine load—

$$f'(P_1) = 0 = -\frac{48959.3}{P_1^2} + 0.0116$$

$$0.0116P_1^2 = 48959.3$$

$$P_1 = 2{,}055 \text{ kW}$$

As explained herein above, multiple candidate engine-specific fuel consumption models may be generated for each engine. The engine-specific fuel consumption model used to determine a predicted fuel consumption can be selected from amongst the candidate engine-specific fuel consumption models.

The engine-specific fuel consumption model can be selected from the multiple candidate engine-specific fuel consumption models by comparing the candidate engine-specific fuel consumption models to one or more expected model characteristics. The expected model characteristic can include the engine load at which the predicted fuel consumption is expected to be a minimum (e.g. based on specifications associated with the engine, such as manufacturer testing or specifications). For example, engine #1 may be expected to provide a minimum fuel consumption at 80% engine load. Accordingly, the minimum fuel consumption load from each candidate engine-specific fuel consumption models can be compared to this expected 80% engine load value. The engine-specific fuel consumption model can be selected from amongst the candidate engine-specific fuel consumption models that are within a specified range of the expected characteristics. For instance, the engine-specific fuel consumption model can be selected as the candidate engine-specific fuel consumption models with a minimum engine load value closest to the expected model characteristics.

Optionally, a calibration range may be provided. For example, the engine-specific fuel consumption model may be selected from amongst candidate engine-specific fuel consumption models falling within the calibration range. In the example given above, the engine-specific fuel consumption model may be selected from amongst candidate engine-specific fuel consumption models whose output shows minimum fuel consumption at approximately 80%±5% engine load.

Figure 8B:
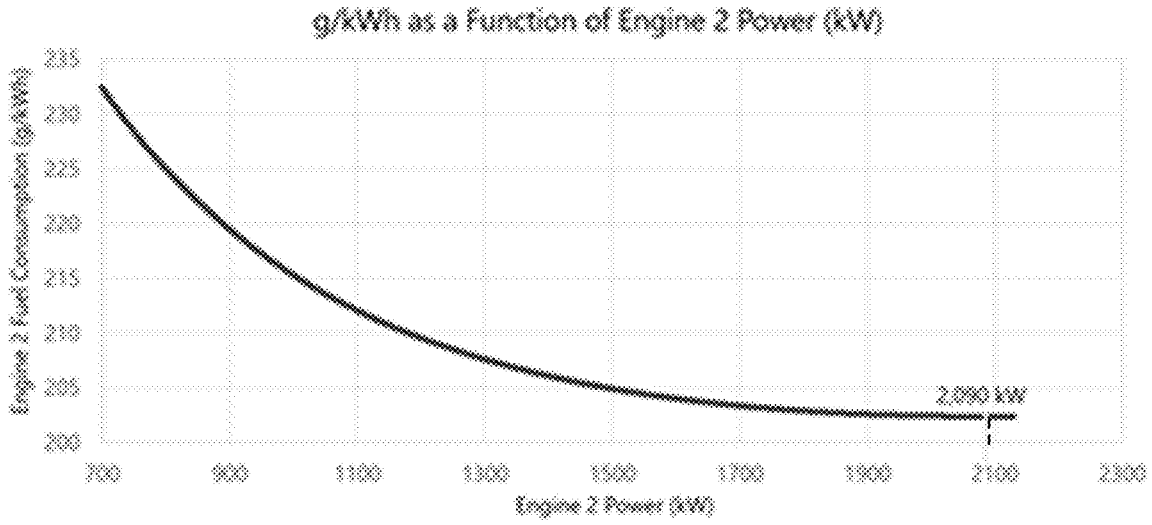

FIG. 8B shows predicted fuel consumption versus engine power output for the engine #2. The corresponding engine-specific fuel consumption model may be expressed as—

$$f(P_2)\frac{g}{\text{kWh}} = \frac{47662.71}{P_2} + 156.73 + 0.01091P_2$$

Using the first derivative of the model equation, the minimum fuel consumption for engine #2 can be determined to occur at 2,090 kW or approximately 81% of engine load—

$$f'(P_2) = 0 = -\frac{47662.71}{P_2^2} + 0.01091$$

$$0.01091P_2^2 = 47662.71$$

$$P_2 = 2{,}090 \text{ kW}$$

Figure 8C:
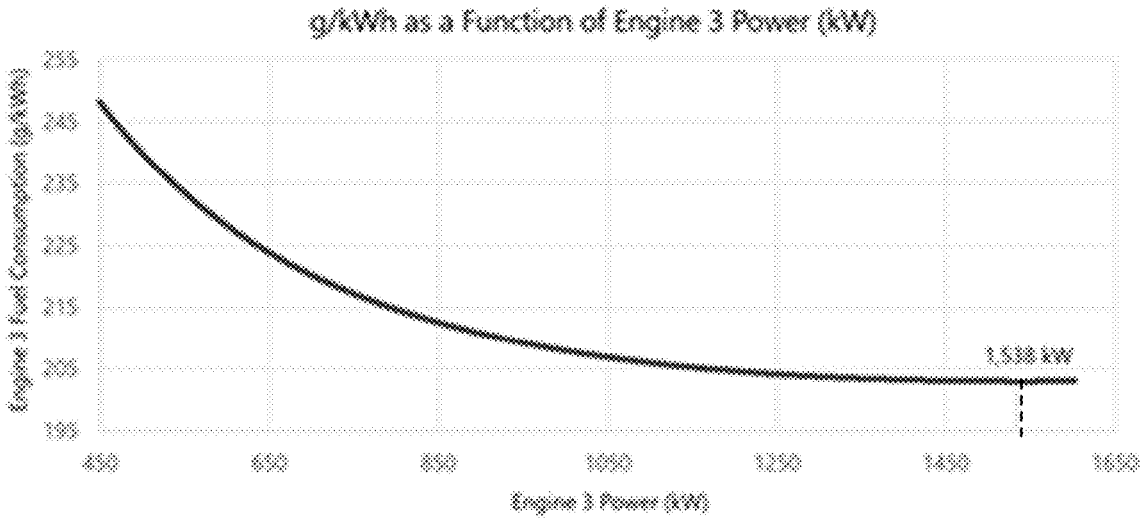

FIG. 8C shows predicted fuel consumption versus engine power output for the engine #3. The corresponding engine-specific fuel consumption model may be expressed as—

$$f(P_3)\frac{g}{\text{kWh}} = \frac{40603.96}{P_3} + 150.21 + 0.01712P_3$$

Using the first derivative of the model equation, the minimum fuel consumption for engine #3 can be determined to occur at 1,538 kW or approximately 80% of engine load—

$$f'(P_3) = 0 = -\frac{40603.96}{P_3^2} + 0.01712$$

$$0.01712P_3^2 = 40603.96$$

$$P_3 = 1{,}538 \text{ kW}$$

Figure 8D:
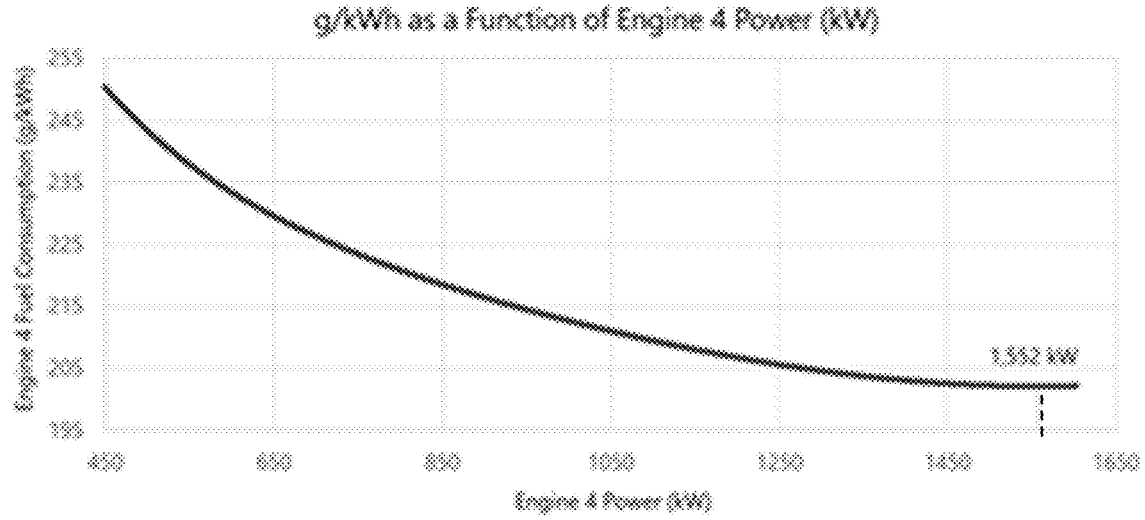

FIG. 8D shows predicted fuel consumption versus engine power output for the engine #4. The corresponding engine-specific fuel consumption model may be expressed as—

$$f(P_4)\frac{g}{\text{kWh}} = \frac{41027.0146}{P_4} + 122.913 + 0.12P_4 - 0.000099P_4^2 + 0.00000002828P_4^3$$

Using the first derivative of the model equation, the minimum fuel consumption for engine #4 can be determined to occur at 1,552 kW or approximately 81% of engine load—

$$f'(P_4) = 0 = -\frac{41027.0146}{P_4^2} + 0.12 - 0.000198P_4 + 0.000000084P_4^2$$

$$P_4 = 1{,}552 \text{ kW}$$

Figure 9:
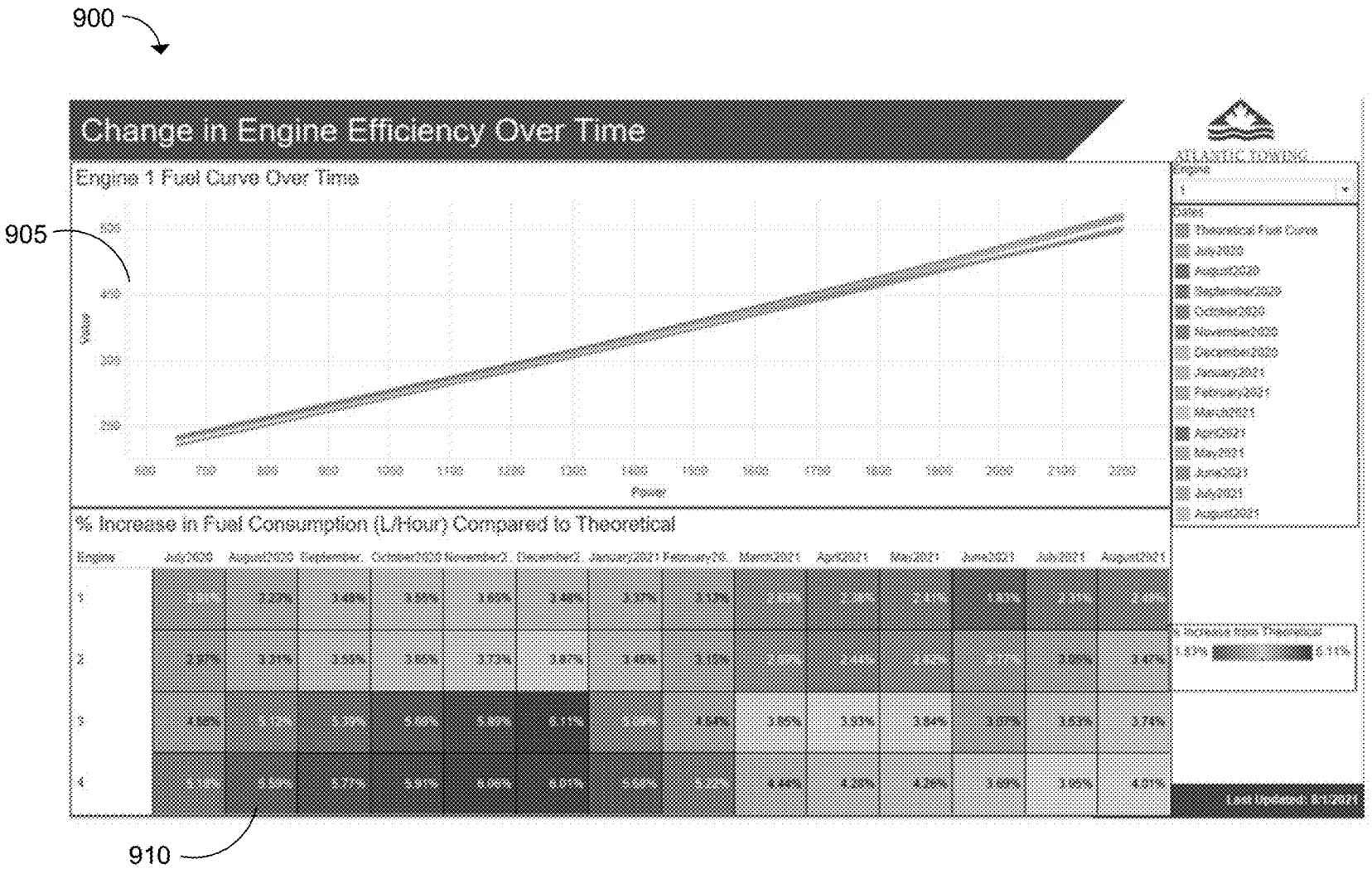
FIG. 9 illustrates an example report display showing change in fuel efficiency over time for an example thrust engine.

Referring now to FIG. 9, shown therein is an example user interface display 900 illustrating a change in fuel efficiency over time for an example thrust engine.

As illustrated, user interface 900 can include a graph portion 905 showing predicted fuel consumption outputs generated by an engine-specific fuel consumption model over a time period as well as actual fuel consumption for the corresponding engine for different operational time periods. Report 900 can also include a table portion 910 summarizing changes in fuel efficiency for various thrust engines of a vessel over time.

The current engine performance (as indicated by current engine fuel efficiency compared with initial engine fuel efficiency) may be evaluated based on the predicted fuel consumption outputs generated by the engine-specific fuel consumption model. Predictive or planned engine maintenance may be performed based on the outputs generated by the engine-specific fuel consumption models.

The control unit 110 may monitor actual fuel consumption of engines 130 using fuel consumption data received from sensors 120. Fora particular thrust engine, the predicted fuel consumption output generated by corresponding engine-specific fuel consumption model may be compared with the actual fuel consumption. Based on the comparison, the engine-specific fuel consumption model may be adjusted. For the example engine #2, model training engine 228 may determine a difference between the predicted fuel consumption output generated by the engine-specific fuel consumption model and the actual fuel consumption. In response, model training engine 228 may adjust the engine-specific fuel consumption model based on the determined difference. Alternately or in addition, the control unit 110 may output a deviation message indicating that the actual fuel consumption has drifted over time from the predicted fuel consumption.

Figure 10A:
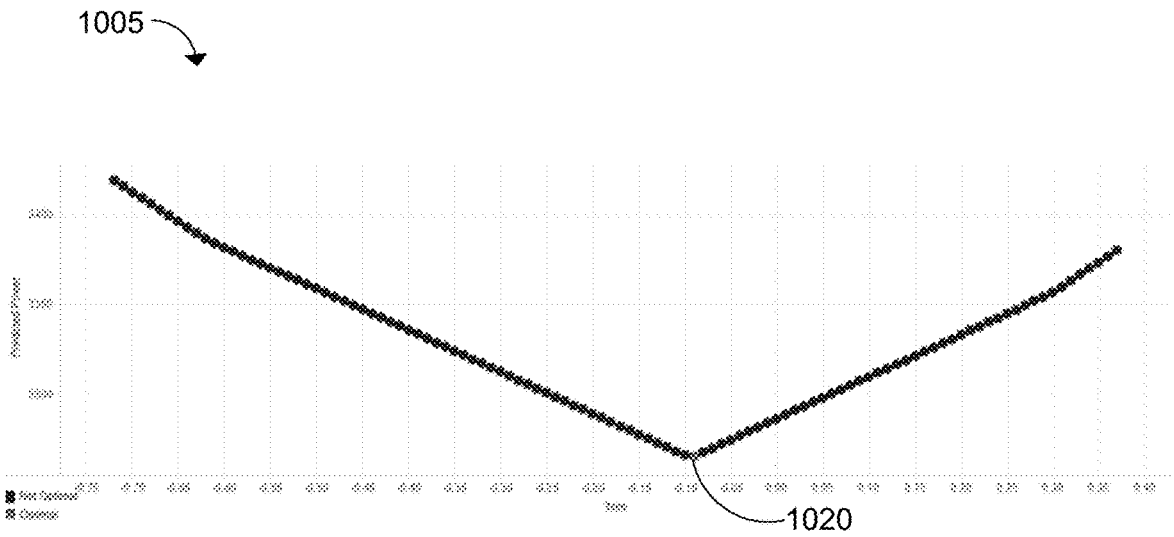
FIGS. 10A and 10B illustrate example graphs showing predicted total needed power output generated by vessel trim models.
Figure 10B:
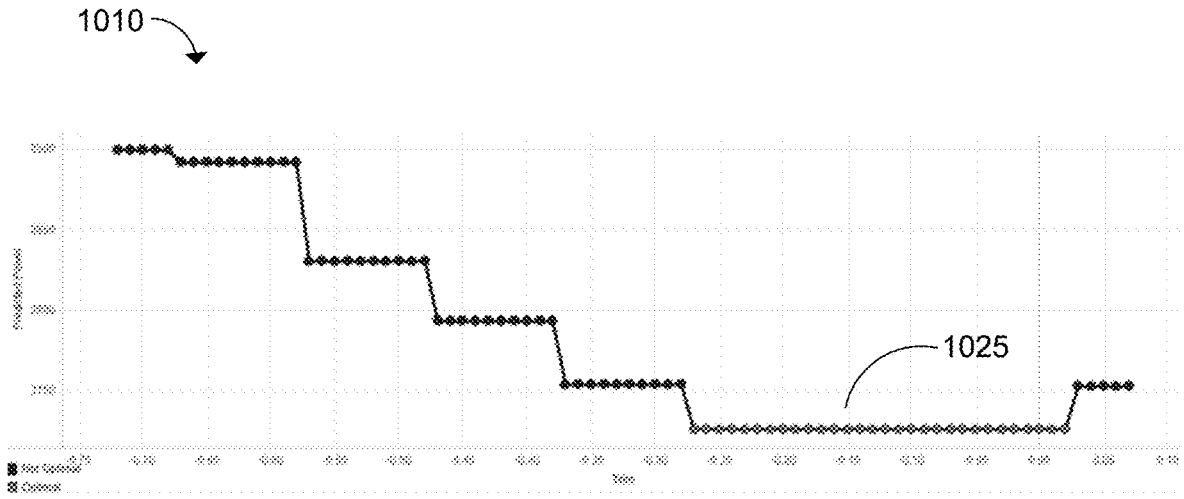

Example implementations of vessel trim models using different types of machine learning models were tested. FIGS. 10A and 10B show plots of the predicted total needed power output generated by example implementations of vessel trim models. The plots shown in FIGS. 10A and 10B illustrate the expected power needed from the thrust engines of a vessel to provide a specific vessel speed at a specific vessel average draft for a range of potential vessel trim values.

The plot shown in FIG. 10A illustrates the predicted total needed power generated using a deep neural network as described herein above with respect to method 400. As shown in FIG. 10A, the minimum predicted total needed power is identified at a specified trim value 1020.

The plot shown in FIG. 10B illustrates the predicted total needed power generated using a gradient booster model in an example implementation of method 400. As shown in FIG. 10B, the minimum predicted total needed power is identified to occur at a range of trim values 1025.

Table 1 below provides a summary of the Mean Absolute Error (MAE) and Mean Absolute Percentage Error (MAPE) for example implementations of vessel trim models in predicting total needed power to provide a specific vessel speed and a specific vessel average draft for a range of vessel trim values.

TABLE 1

Error Values of Example Machine Learning Models Used to Implement Vessel Trim Model

| Machine Learning Model Type | MAE | MAPE |
|---|---|---|
| Linear Regression | 518.5 | 18.9% |
| 2nd degree polynomial | 377.8 | 13.6% |
| Decision Tree | 402.3 | 14.6% |
| Spline (1 degree) | 361.1 | 13.1% |
| Spline (2 degree) | 357.9 | 13.0% |
| Gradient Boosted Machine:<br>distribution = "gaussian",<br>n.trees = 109,<br>interaction.depth = 3,<br>shrinkage = 0.1,<br>n.minobsinnode = 10,<br>bag.fraction = 0.5,<br>n.cores = NULL,<br>verbose = FALSE | 345.3 | 12.7% |
| Keras Deep Neural Network:<br>layer_dense(units = 72,<br>activation = "relu",<br>input_shape = c(3)) %>%<br>layer_dropout(0.2) %>%<br>layer_dense(units = 72,<br>activation = "relu") %>%<br>layer_dropout(0.2) %>%<br>layer_dense(units = 1)<br>loss = "mse",<br>optimizer = optimizer_rmsprop( ),<br>metrics = c("mean_absolute_error"<br>epoch = 50,<br>batch_size = 32,<br>validation_split = 0.1, | 348.1 | 12.8% |

TABLE 1-continued

| Error Values of Example Machine Learning Models Used to Implement Vessel Trim Model | | |
|---|---|---|
| Machine Learning Model Type | MAE | MAPE |
| callbacks = c(callback_early_stopping(monitor = "val_mean_absolute_error", patience = 5)), verbose = 2 | | |

As shown above, a gradient boosted model may provide good accuracy, albeit with an underfit model (as shown in FIG. 10B). Accordingly, a gradient boosted model may be selected where lower model complexity is desired. By contrast, a deep neural network model is well-fit (as shown in FIG. 10A) while still providing good accuracy. Accordingly, a deep neural network may be selected where accuracy is the primary consideration.

Figure 11:
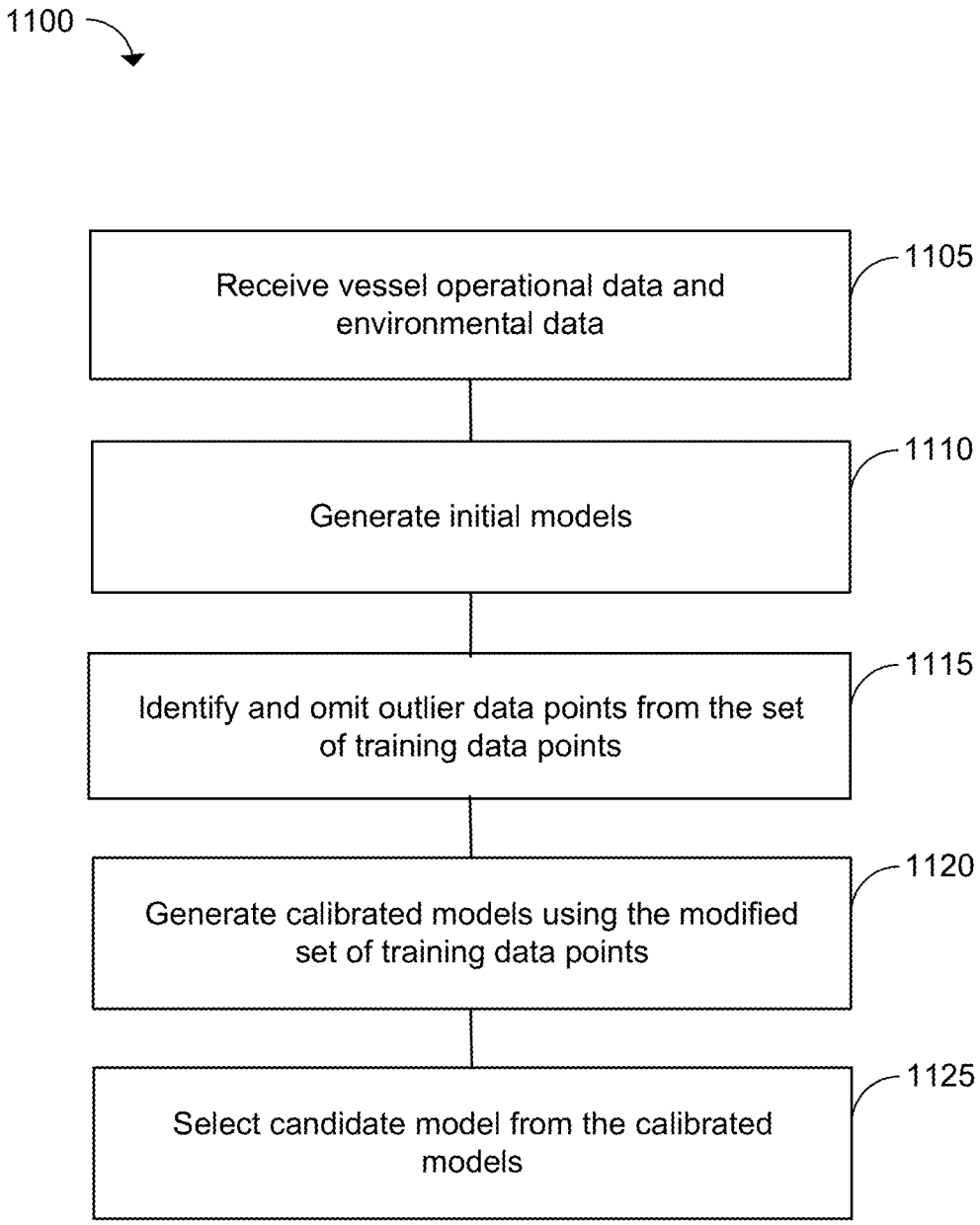
FIG. 11 is a flowchart illustrating an example process for training and calibration of a machine learning model.

Referring now to FIG. 11, shown therein is a flowchart of an example process 1100 for training and calibration of models in accordance with this disclosure. The models may include, for example, a required power model, one or more engine-specific fuel consumption models, and/or a vessel trim model. Process 1100 can be implemented, for example, by model training engine 228 of control unit 110.

Process 1100 may be performed for initial training of models generated by model generation engine 226. Process 1100 may also be performed for further training of the models during regular operation of the vessel. The further training may be performed at regular time intervals. The regular time intervals may be based on a parameter stored in database 224 or provided by a user through I/O unit 212. Further training may also be performed at non-regular time intervals based on a user input received at I/O unit 212. Optionally, the multiple models may provide confidence scores for generated outputs and further training of a model using process 1100 may be performed based on its confidence score falling below a threshold confidence score.

At 1105, vessel operational data and environmental data can be received. For example, control unit 110 may receive vessel operational data and environmental data from sensors 120. Alternatively, the vessel operational data and environmental data may be historical data stored in database 224.

At 1110, an initial model may be generated. For example, model generation engine 226 may generate the initial model and model training engine 228 may train the initial model based on the received vessel operational data and environmental data as described herein above.

At 1115, outlier data points from the set of training data points can be identified. The outlier data points can be omitted from the training data points used to train the machine learning models.

Model training engine 228 may compare an initial engine-specific fuel consumption model with a calibration model that is based on testing performed during manufacturing of the vessel. Model training engine 228 can identify sensor errors by identifying predicted fuel consumption values from the initial engine-specific fuel consumption model that are lower than the corresponding predicted fuel consumption values from the calibration model. Model training engine 228 can modify the set of training data points by discarding received vessel operational data and environmental data corresponding to the identified sensor errors.

Model training engine 228 may also modify the set of training data points by identifying outlier data points as compared to the other data points in the set of training data points. Data points that differ significantly from the other data points in the set of training data points may be identified as outliers and removed.

For example, model training engine 228 can determine a Cook's distance for all the data points in the initial set of training data. An average Cook's distance for the initial set of training data can be determined. Outliers can be identified as those data points with a Cook's distance outside of a specified acceptable range. For example, model training engine 228 may identify data points having a corresponding Cook's distance greater than four times the average Cook's distance as outliers. Alternatively, model training engine 228 may identify outliers based on a threshold that is different from four times the average Cook's distance.

Alternatively, model training engine 228 may use a metric other than the Cook's distance to identify and omit outlier data points.

At 1120, calibrated models can be generated using the modified set of training data points (after omitting outliers at 1115). The calibrated models can be generated in generally the same manner as the initial models, except with a different set of training data.

At 1125, a candidate model can be selected from the calibrated models. Various criteria can be used to select the candidate model. Model accuracy and model complexity are examples of criteria that can be used to select a candidate model.

Optionally, the calibrated model with the highest accuracy can be selected as the candidate model. Alternatively, the calibrated model with the lowest complexity can be selected as the candidate model.

Alternatively, multiple criteria can be used to select the candidate model. For example, a minimum threshold accuracy can be applied to perform an initial selection among the calibrated models and then model complexity can be used to perform the final selection. Alternatively, a multi-variable optimization (e.g. a weighted optimization) may be applied to select the candida model.

Various different model accuracy metrics can be used, such as the mean absolute error, mean absolute percentage error, root-mean-squared error and so forth.

Model complexity may be determined based on the computing resources required by the model during operation.

Example implementations of engine-specific fuel consumption models using different types of machine learning models were tested following calibration according to an example implementation of method 1100. Table 2 below provides a summary of MAE and MAPE for calibrated engine-specific fuel consumption models in predicting engine-specific fuel consumption (L/hr) for a first engine of a vessel. The models generate engine-specific fuel consumption (L/hr) predictions corresponding to power output level (kW). As shown in Table 2, a linear engine-specific fuel consumption model provides a balanced trade-off between model complexity, MAE and MAPE for the first engine.

TABLE 2

| Error Values of Example Machine Learning Models Used to Implement a First Engine-Specific Fuel Consumption Model | | |
|---|---|---|
| Model | MAE | MAPE |
| Polynomial (6th Degree) | 7.14 | 5.32% |
| Polynomial (5th Degree) | 7.14 | 5.32% |
| Polynomial (4th Degree) | 7.14 | 5.32% |
| Spline | 7.19 | 5.35% |
| Polynomial (3rd Degree) | 7.29 | 5.38% |

TABLE 2-continued

| Error Values of Example Machine Learning Models Used to Implement a First Engine-Specific Fuel Consumption Model | | |
|---|---|---|
| Model | MAE | MAPE |
| GBM | 7.29 | 5.39% |
| Polynomial (2nd Degree) | 7.41 | 5.49% |
| Linear | 7.56 | 5.69% |
| Keras Deep Learning Neural Network: 3 hidden layers, 35 neurons | 9.95 | 7.24% |
| Decision Tree | 17.73 | 11.05% |

Table 3 below provides a summary of MAE and MAPE for calibrated engine-specific fuel consumption models in predicting engine-specific fuel consumption (L/hr) for a second engine of a vessel. The models generate engine-specific fuel consumption (L/hr) predictions corresponding to power output level (kW).

TABLE 3

| Error Values of Example Machine Learning Models Used to Implement a Second Engine-Specific Fuel Consumption Model | | |
|---|---|---|
| Model | MAE | MAPE |
| Polynomial (6th Degree) | 6.24 | 4.87% |
| Polynomial (5th Degree) | 6.24 | 4.88% |
| Polynomial (4th Degree) | 6.25 | 4.88% |
| Spline | 6.26 | 4.88% |
| Polynomial (3rd Degree) | 6.32 | 4.91% |
| GBM | 6.40 | 4.94% |
| Polynomial (2nd Degree) | 6.41 | 4.98% |
| Linear | 6.64 | 5.25% |
| Keras Deep Learning Neural Network: 3 hidden layers, 35 neurons | 9.99 | 7.63% |
| Decision Tree | 17.59 | 11.54% |

Table 4 below provides a summary of MAE and MAPE for calibrated engine-specific fuel consumption models in predicting engine-specific fuel consumption (L/hr) for a third engine of a vessel. The models generate engine-specific fuel consumption (L/hr) predictions corresponding to power output level (kW).

TABLE 4

| Error Values of Example Machine Learning Models Used to Implement a Third Engine-Specific Fuel Consumption Model | | |
|---|---|---|
| Model | MAE | MAPE |
| Polynomial (4th Degree) | 5.24 | 4.97% |
| Polynomial (5th Degree) | 5.24 | 4.98% |
| Polynomial (3rd Degree) | 5.25 | 4.97% |
| Polynomial (6th Degree) | 5.25 | 4.98% |
| Spline | 5.28 | 5.00% |
| GBM | 5.30 | 5.00% |
| Polynomial (2nd Degree) | 5.32 | 4.98% |
| Linear | 5.44 | 5.17% |
| Keras Deep Learning Neural Network: 3 hidden layers, 35 neurons | 7.39 | 6.94% |
| Decision Tree | 10.73 | 9.48% |

Table 5 below provides a summary of MAE and MAPE for calibrated engine-specific fuel consumption models in predicting engine-specific fuel consumption (L/hr) for a fourth engine of a vessel. The models generate engine-specific fuel consumption (L/hr) predictions corresponding to power output level (kW).

TABLE 5

| Error Values of Example Machine Learning Models Used to Implement a Fourth Engine-Specific Fuel Consumption Model | | |
|---|---|---|
| Model | MAE | MAPE |
| Polynomial (6th Degree) | 4.49 | 4.34% |
| Spline | 4.51 | 4.35% |
| Polynomial (5th Degree) | 4.52 | 4.36% |
| Polynomial (4th Degree) | 4.53 | 4.38% |
| Polynomial (3rd Degree) | 4.54 | 4.39% |
| Polynomial (2nd Degree) | 4.56 | 4.41% |
| GBM | 4.66 | 4.46% |
| Linear | 4.67 | 4.54% |
| Keras Deep Learning Neural Network: 3 hidden layers, 35 neurons | 8.12 | 7.73% |
| Decision Tree | 9.02 | 7.71% |

Example implementations of required power models using different types of machine learning models and different sets of input variables were tested. Table 6 below provides a summary of MAE and MAPE for the tested required power models in predicting required power based on vessel operational data and environmental data. The received data was filtered to exclude pitch, heave and roll values outside a −11° to 11° range and to remove null values. In the example implementation, the input variables were provided as individual "point in time" inputs.

TABLE 6

| Error Values of Example Machine Learning Models Used to Implement a Required Power Model for Different Sets of Input Variables | | | | |
|---|---|---|---|---|
| | Variables: Vessel Speed, Wind Speed, Wind Direction, Pitch, Heave, Roll | | Variables: Vessel Speed, Wind Speed, Wind Direction | |
| Model | MAE | MAPE | MAE | MAPE |
| Linear Regression | 433.9 | 18.4% | 434.5 | 18.5% |
| $2^{nd}$ degree polynomial | 236.8 | 9.6% | 237.3 | 9.6% |
| Decision Tree | 280.4 | 11.3% | 280.4 | 11.3% |
| Spline (1 degree) | 222.4 | 9.0% | 223.1 | 9.0% |
| Spline (2 degree) | 213.3 | 8.8% | 214.8 | 8.8% |
| Gradient boosted machine: distribution="gaussian" n.trees=110, interaction.depth=5, shrinkage=0.1, n.minobsinnode=10, bag.fraction=0.5, n.cores=NULL, verbose=FALSE | 187.1 | 8.0% | 186.6 | 8.0% |

As shown in Table 6, a gradient boosted machine may be selected to provide good accuracy for the required power model. No accuracy gain was observed by including the filtered heave, pitch and roll as input variables for the model. Accordingly, heave, pitch and roll may be omitted as inputs to the model to reduce model complexity.

Example implementations of required power models using different types of machine learning models and different sets of input variables were tested. Table 7 below provides a summary of MAE and MAPE for example required power models in predicting required power based on vessel operational data and environmental data. Null values were removed but the received data was not filtered to exclude pitch, heave and roll values outside a specific range. In the example implementation, the input variables were provided as individual "point in time" inputs.

TABLE 7

Error Values of Example Machine Learning Models Used to Implement a Required Power Model for Different Sets of Input Variables

| Model | Variables: Vessel Speed, Wind Speed, Wind Direction, Pitch, Heave, Roll | | Variables: Vessel Speed, Wind Speed, Wind Direction | | Variables: Vessel Speed, Wind Speed, Wind Direction, Heave | |
|---|---|---|---|---|---|---|
| | MAE | MAPE | MAE | MAPE | MAE | MAPE |
| Linear Regression | 462.0 | 17.4% | 463.7 | 17.4% | 463.6 | 17.4% |
| $2^{nd}$ degree polynomial | 284.9 | 10.0% | 288.0 | 10.1% | 286.0 | 10.0% |
| Decision Tree | 365.0 | 12.8% | 365.0 | 12.8% | 365.0 | 12.8% |
| Spline (1 degree) | 276.2 | 9.7% | 280.7 | 9.8% | 277.8 | 9.8% |
| Spline (2 degree) | 274.5 | 9.7% | 277.0 | 9.8% | 273.4 | 9.6% |
| Gradient boosted machine: distribution="gaussian" n.trees=110, interaction.depth=5, shrinkage=0.1, n.minobsinnode=10, bag.fraction=0.5, n.cores=NULL, verbose=FALSE | 243.9 | 8.8% | 244.5 | 8.9% | 244.8 | 8.8% |

As shown in Table 7, a gradient boosted machine may be selected to provide good accuracy for the required power model. No accuracy gain was observed by including the filtered heave, pitch and roll as input variables for the model. Accordingly, heave, pitch and roll may be omitted as inputs to the model to reduce model complexity.

Example implementations of required power models using a gradient boosted machine and different sets of input variables were also tested. Table 8 below provides a summary of MAE for the example implementations of the required power model in predicting required power based on vessel operational data and environmental data. In the example implementations tested, the vessel speed, wind speed and wind direction data values were provided as individual point-in-time inputs and the vessel pitch, vessel heave and vessel roll data were provided as aggregate value inputs. The example implementations were tested using different specified time periods of 30 seconds, 1 minute, 2 minutes, 5 minutes, and 10 minutes for the aggregate value inputs. An "Absolute Maximum" statistical function was used to determine the aggregate value inputs for the corresponding specified time period. In the final example tested, the vessel pitch, vessel heave and vessel roll were omitted.

TABLE 8

Error Values of an Example Machine Learning Model Used to Implement a Required Power Model for Different Sets of Input Variables

| Processed Time Period | Variables: Vessel Speed, Wind Speed, Wind Direction, Pitch, Heave, Roll | | | | | Variables: Vessel Speed, Wind Speed, Wind Direction |
|---|---|---|---|---|---|---|
| | 30 s | 1 min | 2 mins | 5 mins | 10 mins | |
| Gradient boosted machine: distribution="gaussian" n.trees=110, interaction.depth=5, | 254.3 | 247.2 | 237.6 | 224.0 | 212.6 | 275.3 |

TABLE 8-continued

Error Values of an Example Machine Learning Model Used to Implement a Required Power Model for Different Sets of Input Variables

| Processed Time Period | Variables: Vessel Speed, Wind Speed, Wind Direction, Pitch, Heave, Roll | | | | | Variables: Vessel Speed, Wind Speed, Wind Direction |
|---|---|---|---|---|---|---|
| | 30 s | 1 min | 2 mins | 5 mins | 10 mins | |
| shrinkage=0.1, n.minobsinnode=10, bag.fraction=0.5, n.cores=NULL, verbose=FALSE | | | | | | |

Including aggregate values for the vessel pitch, vessel heave, and vessel roll data as inputs to the required power model may increase the model complexity. However, as shown in Table 8, including the aggregate values for the vessel pitch, vessel heave, and vessel roll provided higher accuracy compared with a model using only the vessel speed, wind speed and wind direction as inputs (for all specified time period). A specified time period of 10 minutes was found to provide significantly higher accuracy.

Including the vessel pitch, vessel heave, and vessel roll also plays a secondary function in terms of a practical implementations. The inventors have found that vessel operators expect that the vessel pitch, vessel heave and vessel roll impact the required power and therefore the fuel efficiency. Therefore, including the vessel pitch, vessel heave and vessel roll data as inputs to the required power model can further increase operator confidence in the required power model and thereby result in greater adoption.

As will be apparent to a person of skill in the art, certain adaptations and modifications of the described methods can be made, and the above discussed embodiments of determining an optimum engine configuration should be considered to be illustrative and not restrictive.

While the above description describes features of example embodiments, it will be appreciated that some features and/or functions of the described embodiments are susceptible to modification without departing from the spirit and principles of operation of the described embodiments. For example, the various characteristics which are described by means of the represented embodiments or examples may be selectively combined with each other. In other instances, well-known methods, procedures and components have not been described in detail so as not to obscure the description of the embodiments. Accordingly, what has been described above is intended to be illustrative of the claimed concept and non-limiting. It will be understood by persons skilled in the art that other variants and modifications may be made without departing from the scope of the invention as defined in the claims appended hereto. The scope of the claims should not be limited by the preferred embodiments and examples, but should be given the broadest interpretation consistent with the description as a whole.

We claim:

1. A method for determining an optimum engine configuration for a seafaring vessel having a plurality of thrust engines, the method comprising:

receiving vessel operational data and environmental data for a desired voyage, wherein at least some of the vessel operational data and environmental data is received from a plurality of sensors positioned onboard the vessel;

determining a predicted required power by inputting the vessel operational data, the environmental data, and voyage data to a required power model, wherein the required power model is a first machine learning model trained to generate the predicted required power as an output, and the voyage data defines at least one characteristic of the desired voyage; and determining an optimum engine configuration based on the predicted required power, wherein the optimum engine configuration is selected from a plurality of candidate engine configurations, wherein each candidate engine configuration includes a specified number of thrust engines running and a specified power output level of each thrust engine, and for each candidate engine configuration, a sum of power output from each of the thrust engines is at least equal to the predicted required power, wherein the optimum engine configuration is selected by:

for each candidate engine configuration, determining a candidate total predicted fuel consumption amount by:

for each thrust engine running in that candidate engine configuration, determining an engine-specific predicted fuel consumption using an engine-specific fuel consumption model defined for that thrust engine, wherein each fuel consumption model includes a machine learning model configured to receive a power output level for the corresponding thrust engine as an input and to generate the engine-specific predicted fuel consumption by the corresponding thrust engine as an output; and determining the candidate total predicted fuel consumption amount as a sum of the engine-specific predicted fuel consumption determined for each running thrust engine; and selecting the optimum engine configuration from the candidate engine configurations based on the candidate total predicted fuel consumption of each candidate engine configuration.

2. The method of claim 1, wherein the optimum engine configuration is selected as the candidate engine configuration with the lowest candidate total predicted fuel consumption.

3. The method of claim 1, further comprising determining an optimum vessel trim by:

inputting a vessel speed, a vessel average draft, and a plurality of potential vessel trim values to a vessel trim model, wherein the vessel trim model is a second machine learning model trained to output a total needed power value that represents an expected power needed from the plurality of thrust engines to provide the specific vessel speed, vessel average draft, and potential vessel trim value; and determining the optimum vessel trim as the potential vessel trim value that corresponds to a minimum total needed power value.

4. The method of claim 1, further comprising displaying the optimum engine configuration on an engine configuration user interface.

5. The method of claim 1, further comprising adjusting a power output level of one or more of the thrust engines to match the optimum engine configuration.

6. The method of claim 1, further comprising:

monitoring fuel consumption of the plurality of thrust engines;

determining a difference between the candidate total predicted fuel consumption amount for the optimum engine configuration and the monitored fuel consumption; and displaying an indication of the difference on a fuel consumption user interface.

7. The method of claim 1, further comprising:

monitoring fuel consumption of the plurality of thrust engines;

for a particular thrust engine, determining that the engine-specific predicted fuel consumption is different from the monitored fuel consumption; and adjusting the engine-specific fuel consumption model for that particular thrust engine.

8. The method of claim 1, wherein for each thrust engine, the engine-specific fuel consumption model is defined by:

training the engine-specific fuel consumption model using a set of training data points defined based on the received vessel operational data and environmental data;

wherein training the engine-specific fuel consumption model comprises calibrating the engine-specific fuel consumption model using expected operational data for the corresponding thrust engine.

9. The method of claim 8, wherein calibrating the engine-specific fuel consumption model comprises:

identifying outlier data points in an initial set of data points from the received vessel operational data and environmental data; and omitting the outlier data points from the set of training data points used to train the engine-specific fuel consumption model.

10. The method of claim 9, wherein identifying the outlier data points comprises:

determining a corresponding Cook's distance for the initial set of data points;

determining an average Cook's distance for the initial set of data points; and detecting the outlier data points as any data points having a corresponding Cook's distance greater than four times the average Cook's distance.

11. The method of claim 1, wherein for each thrust engine, the engine-specific fuel consumption model is defined by:

generating a plurality of candidate fuel consumption models;

determining at least one expected model characteristic; and defining the engine-specific fuel consumption model as the candidate fuel consumption model that best satisfies the at least one expected model characteristic.

12. The method of claim 1, wherein determining the predicted required power comprises:

determining a plurality of potential predicted required power values for a corresponding plurality of potential vessel speeds by, for each potential predicted required power value, inputting the vessel operational data, the environmental data, and voyage data to the required power model, wherein each potential predicted required power value corresponds to a particular potential vessel speed and the vessel operational data for each potential predicted required power value includes the corresponding particular potential vessel speed;

identifying a desired vessel speed from amongst the plurality of potential vessel speeds; and determining the predicted required power as the potential predicted required power value corresponding to the desired vessel speed.

13. The method of claim 12, wherein the particular potential vessel speed corresponding to the lowest potential predicted required power value is selected as the desired vessel speed.

14. A system for determining an optimum engine configuration for a seafaring vessel having a plurality of thrust engines, the system comprising:

a plurality of sensors positioned onboard the vessel;

at least one processor; and at least one data storage unit storing a required power model and a plurality of fuel consumption models corresponding to the plurality of thrust engines, wherein the required power model is a first machine learning model trained to determine a predicted required power, and wherein each fuel consumption model includes a machine learning model configured to receive a power output level for the corresponding thrust engine as an input and to generate an engine-specific predicted fuel consumption by the corresponding thrust engine as an output;

wherein the at least one processor is configured to:

receive vessel operational data and environmental data for a desired voyage, wherein at least some of the vessel operational data and environmental data is received from the plurality of sensors;

determine the predicted required power by inputting the vessel operational data, the environmental data, and voyage data to the required power model, wherein the voyage data defines at least one characteristic of the desired voyage; and determine an optimum engine configuration based on the predicted required power, wherein the optimum engine configuration is selected from a plurality of candidate engine configurations, wherein each candidate engine configuration includes a specified number of thrust engines running and a specified power output level of each thrust engine, and for each candidate engine configuration, a sum of power output from each of the thrust engines is at least equal to the predicted required power, wherein the optimum engine configuration is selected by:

for each candidate engine configuration, determining a candidate total predicted fuel consumption amount by:

for each thrust engine running in that candidate engine configuration, determining an engine-specific predicted fuel consumption using the engine-specific fuel consumption model defined for that thrust engine; and determining the candidate total predicted fuel consumption amount as a sum of the engine-specific predicted fuel consumption determined for each running thrust engine; and selecting the optimum engine configuration from the candidate engine configurations based on the candidate total predicted fuel consumption of each candidate engine configuration.

15. The system of claim 14, wherein the at least one processor is configured to select the optimum engine configuration as the candidate engine configuration with the lowest candidate total predicted fuel consumption.

16. The system of claim 14, wherein:

the at least one data storage unit further stores a vessel trim model, wherein the vessel trim model is a second machine learning model trained to output a total needed power value that represents an expected power needed from the plurality of thrust engines to provide a specific vessel speed, a vessel average draft, and a potential vessel trim value; and the at least one processor is configured to determine an optimum vessel trim by:

inputting the vessel speed, the vessel average draft, and a plurality of potential vessel trim values to a vessel trim model; and determining the optimum vessel trim as the potential vessel trim value that corresponds to a minimum total needed power value.

17. The system of claim 14, wherein the at least one processor is configured to display the optimum engine configuration on an engine configuration user interface.

18. The system of claim 14, wherein the at least one processor is configured to adjust a power output level of one or more of the thrust engines to match the optimum engine configuration.

19. The system of claim 14, wherein the at least one processor is configured to:

monitor fuel consumption of the plurality of thrust engines;

determine a difference between the candidate total predicted fuel consumption amount for the optimum engine configuration and the monitored fuel consumption; and display an indication of the difference on a fuel consumption user interface.

20. The system of claim 14, wherein the at least one processor is configured to:

monitor fuel consumption of the plurality of thrust engines;

for a particular thrust engine, determine that the engine-specific predicted fuel consumption is different from the monitored fuel consumption; and adjust the engine-specific fuel consumption model for that particular thrust engine.

21. The system of claim 14, wherein for each thrust engine, the engine-specific fuel consumption model is defined by:

training the engine-specific fuel consumption model using a set of training data points defined based on the received vessel operational data and environmental data;

wherein training the engine-specific fuel consumption model comprises calibrating the engine-specific fuel consumption model using expected operational data for the corresponding thrust engine.

22. The system of claim 21, wherein the engine-specific fuel consumption model is calibrated by:

identifying outlier data points in an initial set of data points from the received vessel operational data and environmental data; and omitting the outlier data points from the set of training data points used to train the engine-specific fuel consumption model.

23. The system of claim 22, wherein the outlier data points are identified by:

determining a corresponding Cook's distance for the initial set of data points;

determining an average Cook's distance for the initial set of data points; and detecting the outlier data points as any data points having a corresponding Cook's distance greater than four times the average Cook's distance.

24. The system of claim 14, wherein for each thrust engine, the engine-specific fuel consumption model is defined by:

generating a plurality of candidate fuel consumption models;

determining at least one expected model characteristic; and defining the engine-specific fuel consumption model as the candidate fuel consumption model that best satisfies the at least one expected model characteristic.

25. The system of claim 14, wherein the at least one processor is configured to determine the predicted required power by:

determining a plurality of potential predicted required power values for a corresponding plurality of potential vessel speeds by, for each potential predicted required power value, inputting the vessel operational data, the environmental data, and voyage data to the required power model, wherein each potential predicted required power value corresponds to a particular potential vessel speed and the vessel operational data for each potential predicted required power value includes the corresponding particular potential vessel speed;

identifying a desired vessel speed from amongst the plurality of potential vessel speeds; and determining the predicted required power as the potential predicted required power value corresponding to the desired vessel speed.

26. The system of claim 25, wherein the at least one processor is configured to select the particular potential vessel speed corresponding to the lowest potential predicted required power value as the desired vessel speed.

27. A computer program product comprising a non-transitory computer readable medium storing computer executable instructions for configuring a processor to perform a method for determining an optimum engine configuration for a seafaring vessel having a plurality of thrust engines, wherein the method comprises:

receiving vessel operational data and environmental data for a desired voyage, wherein at least some of the vessel operational data and environmental data is received from a plurality of sensors positioned onboard the vessel;

determining a predicted required power by inputting the vessel operational data, the environmental data, and voyage data to a required power model, wherein the required power model is a first machine learning model trained to generate the predicted required power as an output, and the voyage data defines at least one characteristic of the desired voyage; and determining an optimum engine configuration based on the predicted required power, wherein the optimum engine configuration is selected from a plurality of candidate engine configurations, wherein each candidate engine configuration includes a specified number of thrust engines running and a specified power output level of each thrust engine, and for each candidate engine configuration, a sum of power output from each of the thrust engines is at least equal to the predicted required power, wherein the optimum engine configuration is selected by:

for each candidate engine configuration, determining a candidate total predicted fuel consumption amount by:

for each thrust engine running in that candidate engine configuration, determining an engine-specific predicted fuel consumption using an engine-specific fuel consumption model defined for that thrust engine, wherein each fuel consumption model includes a machine learning model configured to receive a power output level for the corresponding thrust engine as an input and to generate the engine-specific predicted fuel consumption by the corresponding thrust engine as an output; and determining the candidate total predicted fuel consumption amount as a sum of the engine-specific predicted fuel consumption determined for each running thrust engine; and selecting the optimum engine configuration from the candidate engine configurations based on the candidate total predicted fuel consumption of each candidate engine configuration.

* * * * *